US005813148A

United States Patent [19]

Guerra

[11] Patent Number: 5,813,148

[45] Date of Patent: Sep. 29, 1998

[54] FOOTWEAR WITH OPTICAL FIBER ILLUMINATING DISPLAY AREAS AND CONTROL MODULE

[76] Inventor: Rafael J. Guerra, 1472 Avon La., #1027, N. Lauderdale, Fla. 33068

[21] Appl. No.: 668,405

[22] Filed: Jun. 21, 1996

Related U.S. Application Data

[60] Provisional application No. 60/015,016 Apr. 8, 1996.

[51] Int. Cl.[6] ..... A43B 23/00

[52] U.S. Cl. ..... 36/137

[58] Field of Search ..... 36/137, 136

[56] References Cited

U.S. PATENT DOCUMENTS

| | | | |
|---|---|---|---|
| 2,557,663 | 6/1951 | Knode | 36/137 |
| 2,801,477 | 8/1957 | Adams et al. | 36/136 |
| 2,931,893 | 4/1960 | Arias et al. . | |
| 3,800,133 | 3/1974 | Duval . | |
| 3,893,247 | 7/1975 | Dana, III . | |
| 4,014,115 | 3/1977 | Reichert . | |
| 4,130,951 | 12/1978 | Powell | 36/137 |
| 4,158,922 | 6/1979 | Dana, III . | |
| 4,234,907 | 11/1980 | Daniel . | |
| 4,845,569 | 7/1989 | Mouissie . | |
| 4,848,009 | 7/1989 | Rodgers . | |
| 4,929,169 | 5/1990 | Fujigaki et al. . | |
| 5,052,131 | 10/1991 | Rondini . | |
| 5,097,396 | 3/1992 | Myers . | |
| 5,188,447 | 2/1993 | Chiang et al. . | |
| 5,226,105 | 7/1993 | Myers . | |
| 5,285,586 | 2/1994 | Goldston et al. . | |
| 5,295,216 | 3/1994 | Halter . | |
| 5,303,485 | 4/1994 | Goldston et al. . | |
| 5,307,345 | 4/1994 | Myers et al. . | |
| 5,312,569 | 5/1994 | Mezei . | |
| 5,312,570 | 5/1994 | Halter . | |
| 5,408,764 | 4/1995 | Wut . | |
| 5,457,900 | 10/1995 | Roy . | |
| 5,502,903 | 4/1996 | Barker | 36/137 |
| 5,577,828 | 11/1996 | Nadel et al. | 36/137 X |
| 5,604,999 | 2/1997 | Barker | 36/137 |
| 5,611,621 | 3/1997 | Chien | 36/137 |
| 5,664,346 | 9/1997 | Barker | 36/137 |

FOREIGN PATENT DOCUMENTS

| | | | |
|---|---|---|---|
| 94015494 | 7/1994 | WIPO | 36/137 |

*Primary Examiner*—Ted Kavanaugh
*Attorney, Agent, or Firm*—McHale & Slavin, PA

[57] ABSTRACT

Footwear with optical fiber illuminating display areas provides emphasis on illuminating certain features of the footwear, such as trademarks, logos, team sports, cartoon characters, and other artistic designs primarily for advertising, decoration and enhancing the visibility of the wearer. Footwear with optical fiber illuminating display areas includes: an optical fiber panel(s) made visible through an opening, window, or transparent material on the sole, upper, or tongue portions of the footwear; a light emitting device(s) which transmits light into the optical fiber panel(s); components and circuits for making the light emitting device(s) and the illuminating optical fiber display areas intermittently flash, alternate flash, alternate colors, sequence in motion, activate by pressure or motion switching, activate by manual switching, or any combination thereof; and batteries for supplying power to the light emitting device and the components and circuits aforementioned. A control module combines the light emitting device(s), components and circuits, and batteries into a housing which is positioned in the heel, sole, upper, or tongue portion of the footwear, depending on the embodiment employed. Such footwear embodiments include and are not limited to athletic shoes (e.g. Tennis, Basketball, aerobic, cross trainers, walking, jogging, running), casual and formal dress shoes, roller skates, Ice skates, and Ski boots.

17 Claims, 17 Drawing Sheets

FOOTWEAR WITH OPTICAL FIBER ILLUMINATING DISPLAY AREAS AND CONTROL MODULE

FIELD OF THE INVENTION

This application claims the benefit under 35 USC 119(e) of a U.S. provisional application Ser. No. 60/015,016, filed Apr. 8, 1996.

The present invention relates to footwear, and more particular to a device for illumination of footwear by use of an optical fiber display system for advertising, decoration and enhancing the visibility of the footwear.

BACKGROUND OF THE INVENTION

It is well known in the art that illumination of footwear can be accomplished by use of light emitting diodes (LED's) made visible through the heel or sole portion of footwear. Examples of such prior art can be found in U.S. Pat. No. 5,408,764 issued to Wut, U.S. Pat. No. 5,303,485 issued to Goldston, and U.S. Pat. No. 5,285,586 issued to Goldston et al. However, this similarity of construction provides a primary shortcoming. Light in the heel or sole portions of the footwear does not provide good visibility due to closeness to the ground. This shortcoming can be attributed to physical size constraints of LED's, limiting placement to the upper and tongue portions of the footwear.

Attempts have been made to display LED's on the upper portion of the footwear by making them miniature in size. An example of such prior art can be found in U.S. Pat. No. 5,457,900 issued to Roy which includes a plurality of LED's along an array. However, application of the LED's to the upper portion of the footwear involves coupling to a power supply source, usually located in the heel. This associated circuitry adds to the cost and complexity of the footwear.

In contrast to previous art work, the present invention provides illumination on the sole, tongue, or upper portions of the footwear by means of thin profile optical fiber display panels instead of protruding LED's. The present invention provides uniform and increased light intensity evenly distributed throughout the illuminated portion of the footwear, whereas LED's provide a point source of illumination that lacks uniformity.

Optical fibers in applications of light transmission have had limited usage in consumer type items. Their use has not gained wide acceptance likely due to the difficulty in manufacturing and economy of production. However, new and improved methods and apparatus for making optical fiber display panels are providing new tools for ease of manufacturing and lowering cost. Examples of prior known art can be found in U.S. Pat. No. 5,312,569 issued to Mezel, U.S. Pat. No. 5,312,570 and U.S. Pat. No. 5,295,216 issued to Halter, U.S. Pat. Nos. 5,097,396 and 5,226,105 issued to Myers, U.S. Pat. No. 5,307,245 issued to Myers et. al., U.S. Pat. No. 4,929,169 to Fujigaki et. al., U.S. Pat. No. 4,845,596 to Moussie, and U.S. Pat. No. 4,234,907 issued to Daniel. Such prior arts describe various methods of weaving, marring, abrading, stamping, and laser cutting the optical fibers in an effort to provide uniform and increased light intensity for back lighting membrane switches and liquid crystal display(LCD) panels, such as used on some automobile instrument panels.

Methods of switching light emitting devices in the footwear are known including those activated by motion of the wearer's foot. Examples of such prior art can be found in U.S. Pat. Nos. 3,893,247 and 4,158,922 issued to Dana III, U.S. Pat. No. 4,848,009 issued to Rodgers, and U.S. Pat. No. 5,408,764 issued to Wut.

In the first three of these patents, motion is sensed by a mercury switch which in turn causes the light emitting device(s) to flash. However, mercury switches have several disadvantages. First, increasing environmental regulation is trying to eliminate mercury switches altogether, due to their toxic effects on living organisms. In fact, when the mercury containing footwear is thrown away in the trash by the consumer, it eventually is destroyed at the landfill where mercury may seep into the ground and contaminate the water below. Another disadvantage of the mercury switch is that it increases company liability. For example, children's curiosity can lure them into intentionally destroying the footwear to see what's inside, at which point they may attempt to taste or swallow the mercury not knowing the lethal effects of the substance.

The last reference to Wut senses motion using a spring coil mechanism which causes the light emitting device(s) to intermittently flash. However, the spring coil mechanism occupies substantial room in the heel, thereby leaving less available space in the heel for other components.

Other well known methods of switching light emitting devices in the footwear have been directed to being activated by a pressure switch which is sensitive to pressure exerted by the underside of the wearer's foot or the underside of the sole when footwear contacts the ground. Examples of such prior known art can be found in U.S. Pat. No. 3,800,133 issued to Duval, U.S. Pat. No. 4,014,115 issued to Reichert, U.S. Pat. No. 5,188,447 issued to Chiang et al, and U.S. Pat. No. 5,457,900 issued to Roy.

In the first two of these, pressure exerted by the wearer's foot makes a contact to the upper pole of the battery which closes the circuit and causes the light emitting device to illuminate. In the third of these, a piezoelectric member and amplifier responds to impact. In the later of these a controller counts steps and calculates velocity to determine rate at which LED's are to be strobed. Such prior arts contain components and circuits which are complicated and costly to produce. In contrast, the present invention utilizes "membrane switch" technology which is simpler, less costly to produce, and makes it possible to integrate the switch with the control module primarily due to its shallow depth.

Other well known methods of switching light emitting devices in the footwear is by use of a manual OFF/ON switch. Examples of such prior known art can be found in U.S. Pat. No. 2,931,893 issued to Arias et. al. and U.S. Pat. No. 5,052,131 issued to Rondini. However, these manual switches require wiring to the power supply source in order to close the circuit. This shortcoming and the associated circuitry adds to the cost and complexity of the footwear. In contrast, the present invention eliminates the need for lengthy wiring since the manual switch and battery are both contained inside the same module. Integrating the switch into the control module is made possible by use of "conductive rubber switch" technology in conjunction with a novel approach that shapes the sole portion of the footwear into the "insulative rubber" portion of the switch. Additionally, the present invention allows the wearer to manually control the module for OFF/ON/AUTO operation, in which AUTO enables the previously mentioned pressure sensitive or motion switch.

U.S. Pat. No. 5,285,586 issued to Goldston et. al. discloses a removable plug-in module located in the sole of the footwear which allows switching and replacement of battery. However, said plug-in module is difficult to seal against contaminants and weather, such as due to rain water. The conductive rubber switch overcomes these deficiencies. In addition, the present invention provides a battery compartment in the control module which is made accessible by a threaded plug, underneath the insole.

Thus, what is lacking in the art is an optical fiber device for illumination of footwear.

SUMMARY OF THE INVENTION

The present invention satisfies this need through provision of an optical fiber panel(s) which consists of a plurality of plastic optical fibers arranged adjacent or parallel each other and lying on a substrate, such as mylar reflective film. These optical fibers transmit the light beamed therein to different locations throughout the panel to provide increased light intensity at specific locations or uniformly distributed throughout the panel(s). Furthermore, the optical fibers may be surface treated by marring, abrasion, heating, refractive coating, engraving, cladding, laser cutting, or stamping, to create a desired pattern or design. In the present invention, surface treatment of the optical fibers is utilized to display trademarks, logos, numbers, words, cartoons, etc.

A primary object of the present invention is to provide footwear with optical fiber illuminating display areas by means of: (A) Making visible an optical fiber panel(s) through an opening, window, or transparent portion made on the sole, upper, or tongue portions of the footwear. (B) Providing a light emitting device(s) which transmits light into the optical fiber panel(s). (C) Providing components and circuits for making the light emitting device(s) and the illuminating optical fiber display area(s) intermittently flash, alternate flash, alternate colors, sequence in motion, activate by pressure or motion switching, activate by manual switching, or any combination thereof. (D) Providing a fixed or replaceable battery for supplying power to the light emitting device(s) and the components and circuits aforementioned. (E) Providing a control module which contains (B), (C), and (D).

In accordance with an object of (A) to the present invention, the upper or tongue portions of the footwear are decorated by forming an opening or window on the outer covering material of the footwear as to provide visibility to the underlying optical fiber panel. This opening or window is formed by an upper overlay which defines the shape of the illuminated area on the footwear. The shape of the illuminated display area can have an unlimited number of figures such as square, rectangular, circular, triangular, elliptical, irregular, etc. Furthermore, the optical fiber panel can be covered by a clear or translucent film to protect it from the elements of dirt and physical damage. Moreover, the clear or translucent film protecting the underlying can contain a design, such as trademarks, logos, names, numbers, words, cartoons, pictures, etc. to further decorate and embellish the footwear. The optical fiber panel is affixed to the footwear outer covering material with an adhesive material and then covered by the upper overlay which is preferably stitched at the outer perimetric edges.

In accordance with an aspect to the present invention, an LED is coupled to an end of the optical fiber panel in order to provide light distribution through an opening or window formed on the sole, upper, or tongue portions of the footwear.

In accordance with another aspect to the present invention, an optical fiber panel which is coupled on one end to an LED, is cut in half in order to provide symmetrical light distribution through an opening or window formed on each side of the upper portions of the footwear. This method of cutting the panel provides illuminated optical fiber display areas on both sides of the footwear which further enhances the visibility of the footwear. In addition, cutting the panel lowers the cost of manufacturing the illuminated footwear.

In accordance with another object of (A) to the present invention, the sole portion of the footwear is decorated uniformly by inserting or embedding the optical fiber panel and making it visible through the transparent portions of the sole. Again, the optical fiber panel can be further embellished by either surface treatment of the fibers or by adding a decorative layer of film.

In accordance with an object of (B) to the present invention, a light emitting device, preferably a "superbright" light emitting diode (LED), is used to transmit light into the optical fiber panel by coupling to one or both ends of the fiber bundles. The LED used can be red, orange, yellow, green, blue, or any other commercially available versions in order to fulfill the decorative outcome desired by the footwear manufacturer. In other aspects to the present invention, the LED can be a "standard LED" type, which uses an LED in a plastic housing; "Blinking LED"type, which uses internal integrated circuit driver & LED within same plastic housing; "Bicolor LED" type, which uses two different colored LED's within same plastic housing; or "Multicolored LED" type, which uses three or more colored LED's within same plastic housing. Other light emitting devices which can be coupled include incandescent lamps fluorescent lamps, and electroluminescent lamps.

In accordance with an aspect to the present invention a "Bicolor LED" is used in conjunction with a "Dual LED" flasher circuit for making the optical fiber display panel alternate colors, such as flashing red and green in turns.

In accordance with an object of (C) to the present invention, the light emitting device or LED in conjunction with the optical fiber panel can be driven from external components and circuits to make it flash, alternate colors, sequence in motion, activate by pressure or motion switching, activate by manual switching, or any combination thereof.

In accordance with an aspect to the present invention, a mercury-free motion switch component which generates a series of contact pulses is used to bring attention to the trademark, logo, advertisement, etc. on the illuminating display area(s) of the footwear.

In accordance with another aspect to the present invention, a pressure sensitive switch, preferably a "membrane switch" is placed in the heel or sole portion of the footwear, either recessed in the insole for foot pressure activation or recessed on the bottom of the outsole for ground contact activation. In either case, the outcome brings attention to the trademark, logo, advertisement, etc. on the illuminating display area(s) of the footwear.

In accordance with an object of (C) to the present invention, components and circuitry have been devised to provide the wearer with the ability to manually activate the optical fiber illuminating display areas. The present invention provides a sealed "conductive rubber switch", preferably behind the heel portion of the footwear as to provide manual control of the components and circuits to make the optical fiber display area(s) activate ON,OFF, FLASH MODE, ALTERNATE COLOR MODE, ALTERNATE FLASH MODE, MOTION ACTIVATE MODE or PRESSURE ACTIVATE MODE, SEQUENCE IN MOTION MODE, or any combination of modes aforementioned.

In accordance with still another aspect to the present invention, footwear with optical fiber illuminating display areas includes: a control module positioned in the heel or sole portion and consisting of a light emitting device(s), preferably an LED(s); components and circuits, preferably on a printed circuit board assembly for making the light emitting device(s) and therefore the illuminating display areas flash, alternate colors, sequence in motion, activate by manual switching, activate by a pressure sensitive or motion switch, or any combination thereof; an optical fiber panel(s) made visible through an opening, window, or transparent material on the sole, upper, or tongue portions of the footwear; and a fixed or replaceable battery for supplying power to the light emitting device(s) and the components and circuits aforementioned.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Although the invention is described in terms of a specific embodiment, it will be readily apparent to those skilled in this art that various modifications, rearrangements and substitutions can be made without departing from the spirit of the invention. The scope of the invention is defined by the claims appended hereto.

Figure 1:
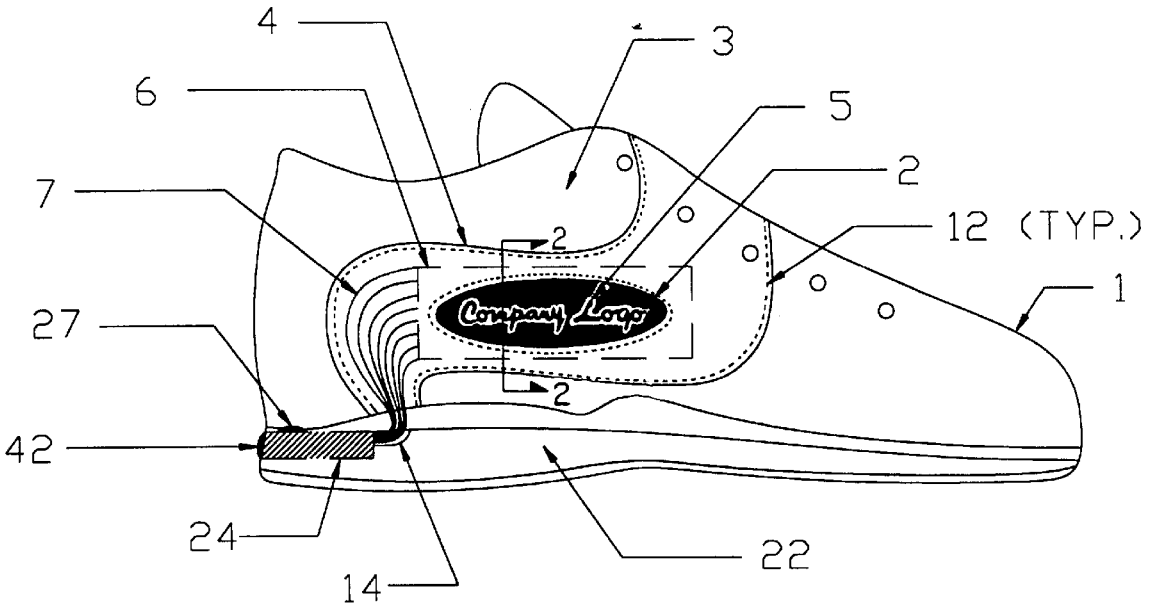
FIG. 1 is a side view of a first embodiment of an athletic footwear made in accordance with the present invention to include an optical fiber illuminating display area and control module.

In accordance with the present invention, first embodiment in FIG. 1 illustrates a type of footwear, well known as an athletic shoe 1, showing an optical fiber illuminating display area 2 on the upper portion 3 of the footwear. This display area is decorated with a "Company Logo" 5 which is exemplary of a design which can be used for advertisement as well as to produce utmost visual impact. The "Company Logo" 5 design is made by either surface treatment of the optical fiber panel 6 or by adding a decorative layer 11 containing this design. The decorative layer 11 can consist of an opaque material, die-cut with letters, numbers, etc. to make visible the underlying illuminated display areas. Additionally, the decorative layer can consist of a translucent layer of film, preferably acrylic for best optical clarity, which can contain a design with opaque/translucent letters, numbers, etc. Surface treatment of the optical fiber panel can be accomplished by abrading, marring, heating, stamping, refractive coating, cladding, and laser cutting in accordance with prior known proprietary methods and other conventional methods. The upper overlay 4 provides a frame for the optical fiber panel 6 and covers its tail portion 7. The upper overlay 4 is preferably made of the same material as the upper portion 3 of the footwear, such as leather or vinyl.

Figure 2:
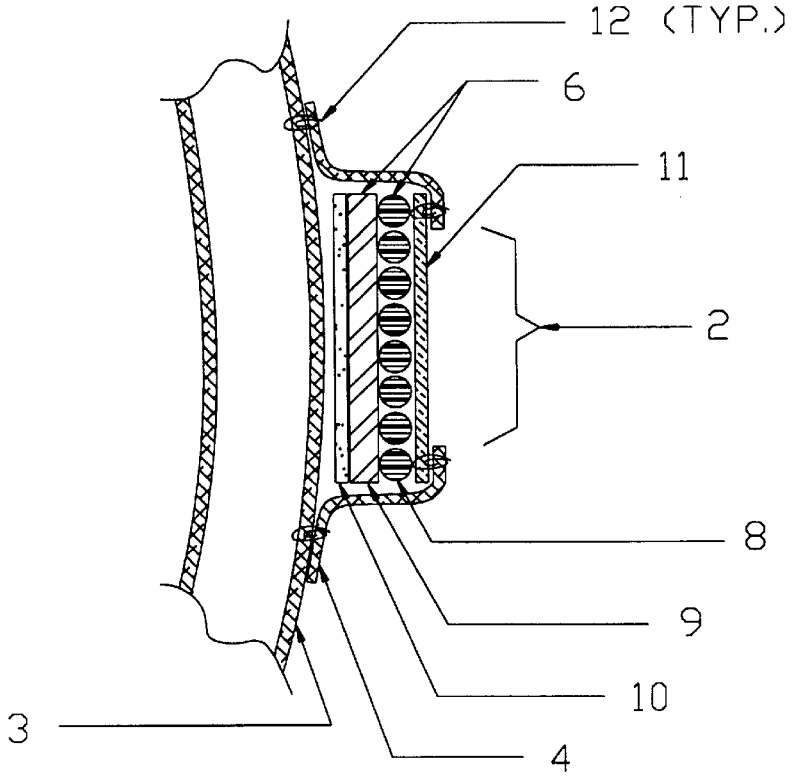
FIG. 2 is a cross-sectional view of the optical fiber display area taken along 2—2 of FIG.1

In accordance with the present invention, FIG. 2 is a cross-sectional view of the optical fiber display area taken along A—A of FIG. 1. This figure illustrates the construction of the optical fiber display area 2. The optical fiber panel 6 consist of a plurality of plastic optical fibers 8 arranged adjacent or parallel each other and lying on a substrate 9, such as mylar reflective film. These optical fibers 8 are preferably made of acrylic polymers which offer excellent optical clarity and transmit the light beamed therein to different locations throughout the panel to provide increased light intensity at specific locations or uniformly distributed throughout the panel. Plastic optical fibers 8 provide several advantages over glass optical fibers in cost, durability, and flexibility which are all important attributes needed on footwear. The optical fiber panel 6 is affixed to the shoe upper 3 with an adhesive material 10, such as double-sided tape or glue. The opening or window is formed by an upper overlay 4 which defines the shape of the illuminated area on the footwear. The shape of the illuminated display area 2 can have an unlimited number of figures such as square, rectangular, circular, triangular, elliptical, irregular, etc. which are preferably made by die-cutting the upper overlay 4 material. As an example, FIG. 1 illustrates an elliptical shape. The opening or window can be covered with a decorative layer 11 containing a design, such as trademarks, logos, names, numbers, words, cartoons, pictures, etc. to further decorate and embellish the footwear. This layer 11 is preferably stitched 12 to the upper overlay 4 at its perimetric edges. Furthermore, this layer 11 can be made of a weather-resistant material, such as a translucent plastic film which protects the underlying optical fiber panel 6 from the elements of dirt and physical damage. Design on a translucent layer of film 11 is preferably achieved utilizing conventional black/white/color photocopying or screen printing equipment. Another method to further decorate the illuminating display area is by adding and opaque film, preferably die-cut with letters, numbers, etc. and placed underneath the clear or translucent layer 11. Still another method which the present invention provides is to encapsulate the optical fiber panel 6 in a clear or translucent polymer, such as transparent grades of silicon.

Figure 3:
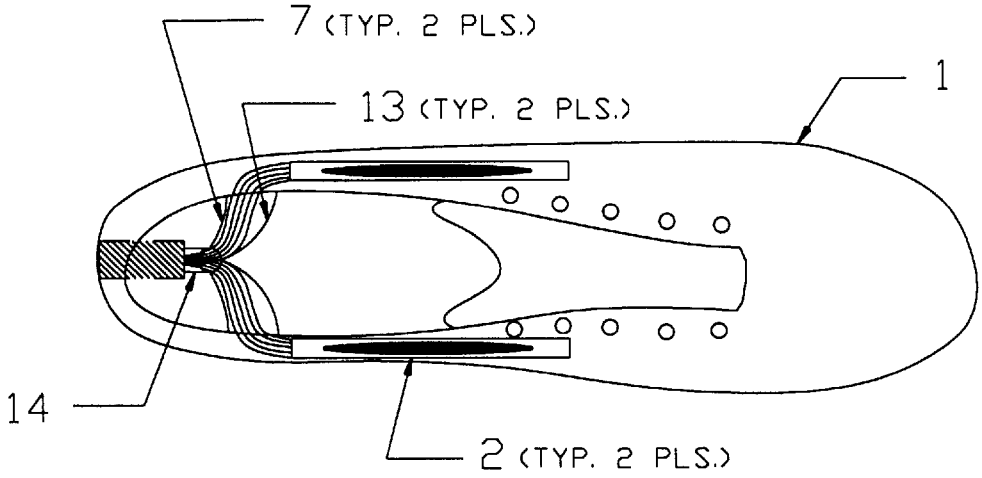
FIG. 3 is a top plan of the footwear in FIG. 1, illustrating optical fiber display area on both sides of the footwear.
Figure 4:
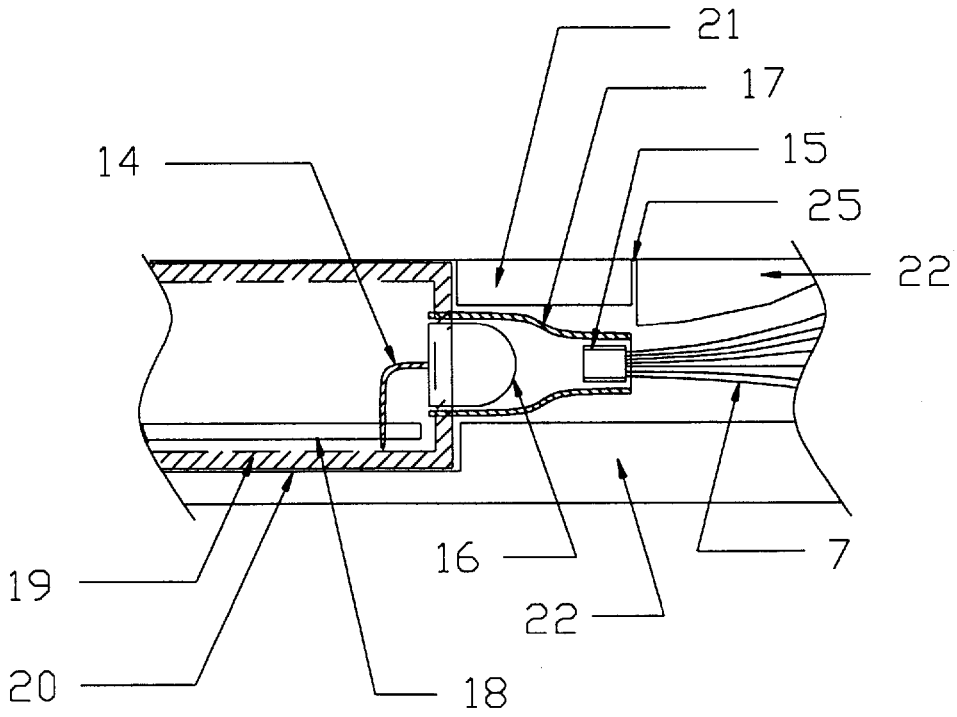
FIG. 4 is a partial side view of the control module coupled to the optical fiber panel.
Figure 5:
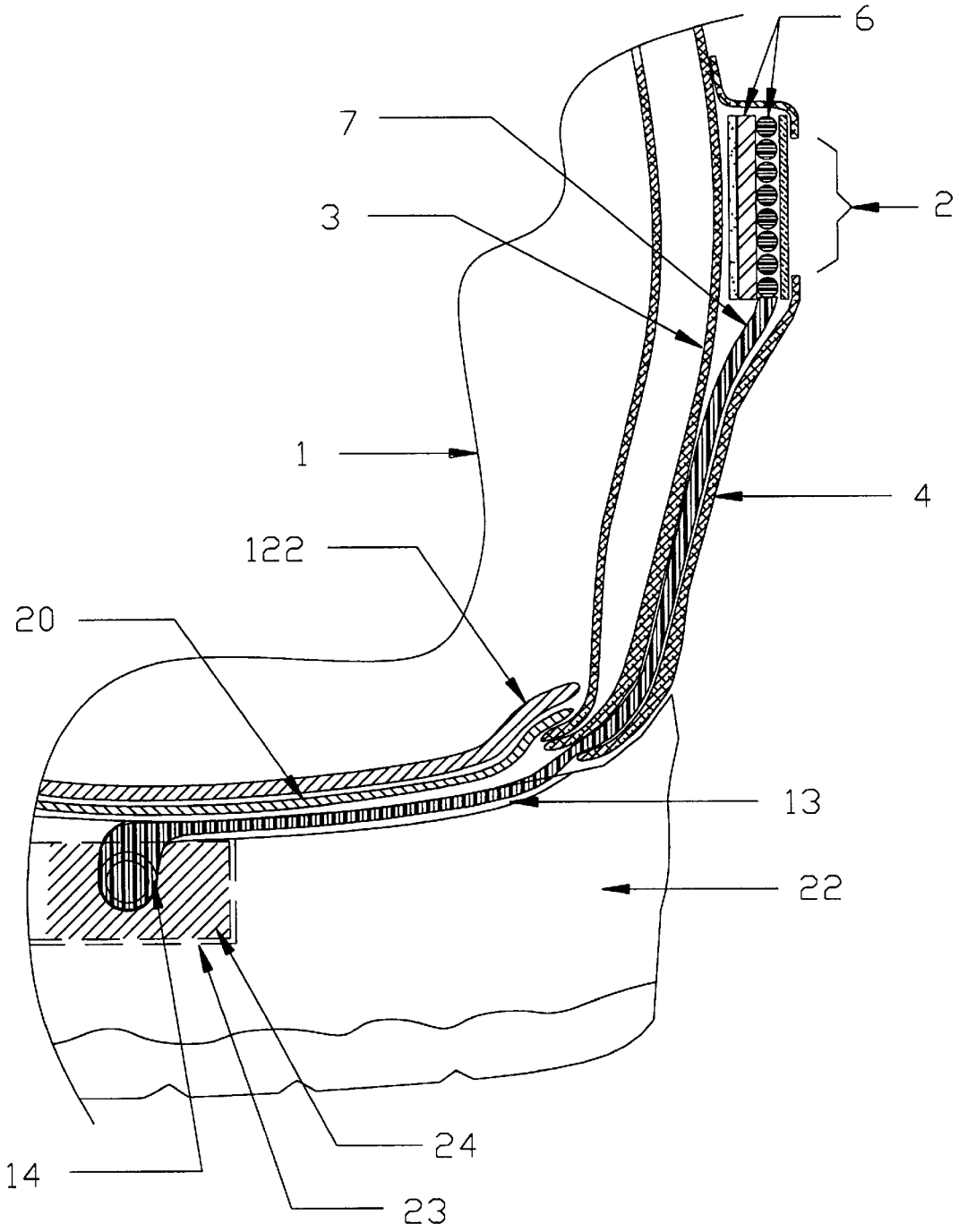
FIG. 5 is a partial cross-sectional view of the footwear in FIG. 1, illustrating the routing of the tail portion of the optical fiber panel.

In accordance with the present invention, FIG. 3 is a top plan of the footwear in FIG. 1, illustrating optical fiber display area 2 on both sides of the footwear. This method provides symmetrical light distribution on the footwear. Moreover, by cutting the optical fiber panel in half along the parallel fibers it is most economically achieved. The "tail" portion 7 of each side panel are routed through the upper surface of the midsole known as the "tail cavities" 13 and into the "tunnel" 14 which is made in the midsole 22 in order to couple into the control module's light emitting device 16, as illustrated in FIG. 4. The "tail cavities" 13 are made to recess the optical fibers beneath the lasting board 20, as illustrated in FIG. 5. The "tunnel" 14 provides a pathway in order to allow insertion of the fiber optic bundle through and into the control module's light emitting device 16. Both the "tail cavity" 13 and "tunnel" 14 are preferably molded into the midsole 22 to provide optimal manufacturing control and lower cost.

In accordance with the present invention, FIG. 4 illustrates a partial side view of the control module's light emitting device 16 coupled to the optical fiber panel "tail" portion 7. The optical fiber bundle ends are polished to provide optical clarity for light transmission. This bundle is held together by a ferrule 15 which can be made of plastic, brass or other. Furthermore, the ferrule 15 is coupled to the light emitting device 16, such as an LED, by means of a heat shrinkable plastic tubing 17. The LED 16 has two leads 14 which are bent at right angles and soldered to the control module's printed circuit board 18. The control module housing 19 is preferably molded of thermoplastic material and have an opening to allow the LED 16 to penetrate through with enough clearance to allow the heat shrinkable tubing 17 to fit. The control module housing 19 seats in the control module cavity 20, which is preferably molded into the shoe midsole 22.

In accordance with the present invention, FIG. 5 is a partial cross-sectional view of the footwear in FIG. 1, illustrating the routing of the "tail" portion 7 of the optical fiber panel 6. The "tail" portion 7 of the optical fiber panel 6 shall be covered by the upper overlay 4 on the exterior of the shoe. The "tail" portion 7 shall be laid on the "tail" cavity 13 which is preferably molded into the upper surface of the midsole 22. This "tail cavity" 13 allows recessing of the "tail" portion 7 of the optical fiber panel 6 which minimizes friction on the fibers that may be caused by the wearer's foot. Athletic activities cause substantial friction that can cause the optical fibers to become broken and thus interrupt the light beamed therein. The "tail cavity" 13 also provides a smooth curvature for the fibers to bend and transition into the "tunnel" portion 14. Again, this prevents possible breakage of the fibers. The "tunnel" portion 14 is preferably molded into the midsole 22 to allow the ferrule 15 holding the fiber bundle to be fed through it with sufficient clearance and bend radius necessary to satisfy mechanical test specifications. The "tunnel" 14 shall extend from the upper surface of the midsole to the control module cavity 23. The control module cavity 23 shall be preferably molded into the midsole portion 22 of the shoe and be sized to contain the control module 24 and have space to allow coupling of the heat shrinkable tubing 17 to the LED 16 with a fine tool such as needle-nose pliers. This working space which is made adjacent to the control module cavity 23 is hereinafter referred to as the "tool cavity" 25 as illustrated on FIG. 4. Upon coupling of the heat shrinkable tubing 17 into the LED 16, a "midsole plug" 21 preferably being of the same material as the midsole 22 and occupying close to the same volume as the "tool" cavity 25 in the midsole shall be inserted. The "midsole plug" 21 shown in FIG. 4 is preferably attached to the midsole "tool cavity" 25 with an adhesive material that will not chemically affect or damage the heat shrinkable tubing 17 material nor the acrylic fibers 8.

Figure 6:
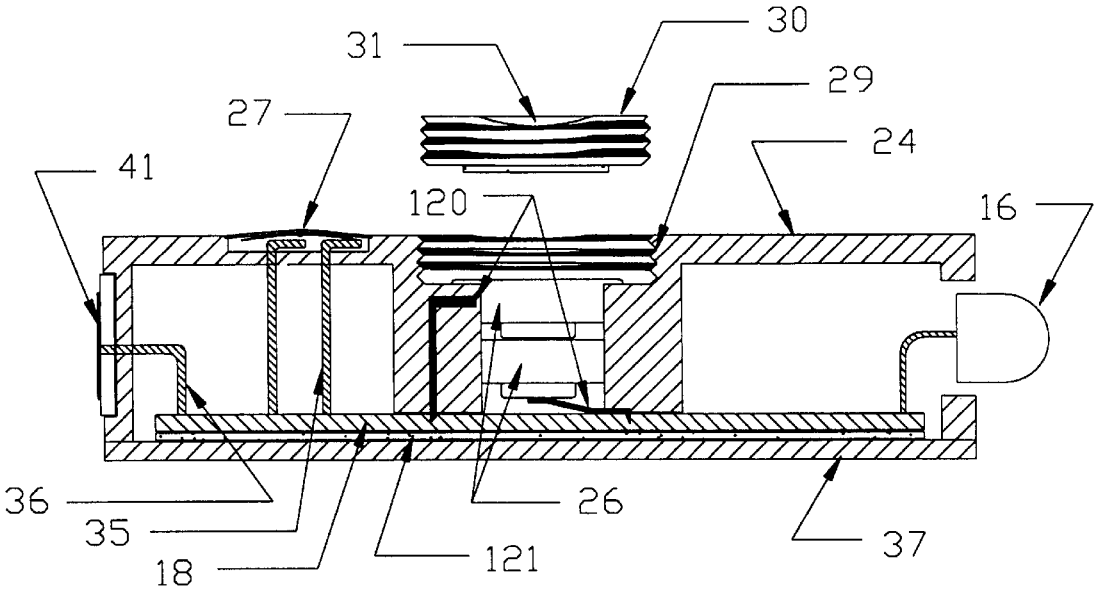
FIG. 6 is a cross-sectional view of the control module, illustrating some of the components contained.

In accordance with the present invention, FIG. 6 is a cross-sectional view of the control module 24, illustrating some of the components contained. The control module housing 19 is preferably constructed of a thermoplastic polymer by injection molding or cast molding. Polyethylene is a preferred choice since it's advantages include: low cost, impact resistance, and good chemical resistance. Another preferred material includes polyurethane which has very strong impact resistance. Furthermore, the control module thermoplastic housing 19 is shaped to integrate the batteries 26, membrane switch 27, and conductive rubber switch 42 into the control module 24. The control module 24 has a threaded socket 29 which allows the batteries 26 (preferably two 1.5 volt cells) to be replaced by removing a plug 30, preferably made of the same material as the control module housing 19. This thermoplastic plug 30 is made with a coin slot 31 which allows the wearer to easily turn the plug 30 clockwise or counterclockwise for battery replacement. This removable plug 30 is made visible to the wearer when he/she lifts a removable insole 122 as illustrated in FIG. 5. The wall portions of the control module 24 which surround the batteries 26 provide a seat for the batteries 26 as well as structural rigidity to the control module 24. Furthermore, by isolating the battery compartment from other circuits and components 25, these are less likely to be exposed to humid conditions. Moreover, in order to prevent moisture from affecting the printed circuit board 18, conformal coating is a preferred solution. Since the walls surrounding the batteries 26 rest on the printed circuit board 18, the present invention utilizes a printed circuit board laminate which has flexural properties to withstand the wearer's weight during athletic activities. A preferred laminate material is epoxy glass, 1/16 inch thickness in accordance with NEMA standards for this reason. Two retaining contacts 120 for the battery are mounted in the printed circuit board 18 to make contact with the batteries 26 and supply power to the light emitting device 16 and other components 25 in the control module 24. These contacts 120 are preferably constructed of nickel plated stamped steel for economy. The membrane switch 27 is recessed into the control module 24 in the membrane switch cavity 32. First, two leads 35 are inserted through holes made in the cavity 32. These leads 35 shall be long enough to fit through the printed circuit board 18 and have a right angle bend on the surface of the membrane switch cavity 32. A metal dome 33, preferably nickel plated on contact side, is placed over the leads in the membrane switch cavity 32. Additional layers of metal domes 33 can be used to increase the actuation force needed to make the switch. Moreover, a polyester overlay 28 with adhesive covers the metal dome 33. As a result, the optical fiber illuminating display area is activated by the wearer's foot.

Figure 7:
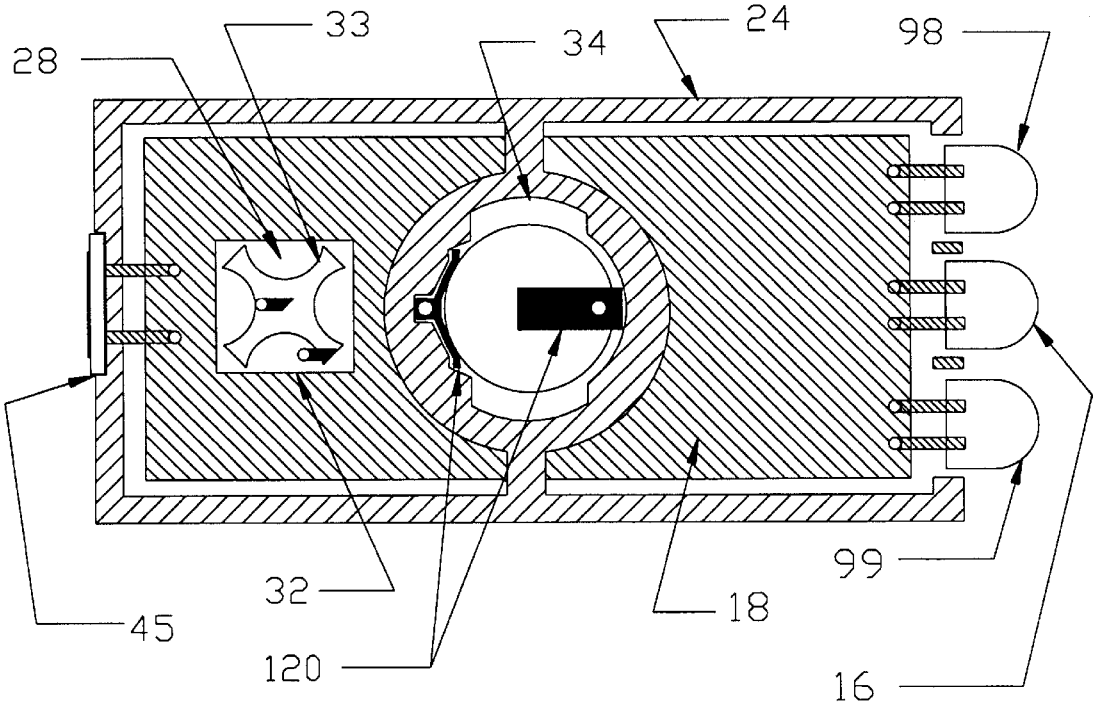
FIG. 7 is a top plan view of the control module, illustrating some of the components contained.

In accordance with the present invention, FIG. 7 is a top plan view of the control module 24, illustrating some of the components contained. In this view, it can be seen that the membrane switch terminal closest to the center of the dome 33 makes contact with the conductive underside of the dome 33 when it senses pressure exerted by the wearer's foot. Therefore, the circuit is closed through the metal dome 33 which causes the optical fiber display area 2 illustrated in FIG. 1 to become illuminated accordingly. Otherwise, this pulse can be sensed by the electronic components and circuits 25 (not shown) and mounted in the printed circuit board 18 which condition the signal to create a desired illuminating effect, such as alternate a bicolor LED on each pulse. Also, it can be seen that the thermoplastic control module housing 19 is molded to seat the batteries 26, leaving two notched openings 34 to allow the wearer to pull the batteries 26 out from the retaining contacts 31 for replacement. Assembly of the control module 24 is preferably done by mounting the manufactured circuit board 18 and components contained 25 (except for membrane switch 27 and conductive rubber switch 42) into the thermoplastic control module housing 19 from below. The leads from the membrane switch 35 and leads from the conductive rubber switch 36 penetrate through predrilled contact holes on the circuit board 18 and soldered from underneath. An assembly cover 37 provides a closure for the control module 24 and is held against the bottom of the printed circuit board 18 preferably with an insulative adhesive tape material 38.

Figure 8:
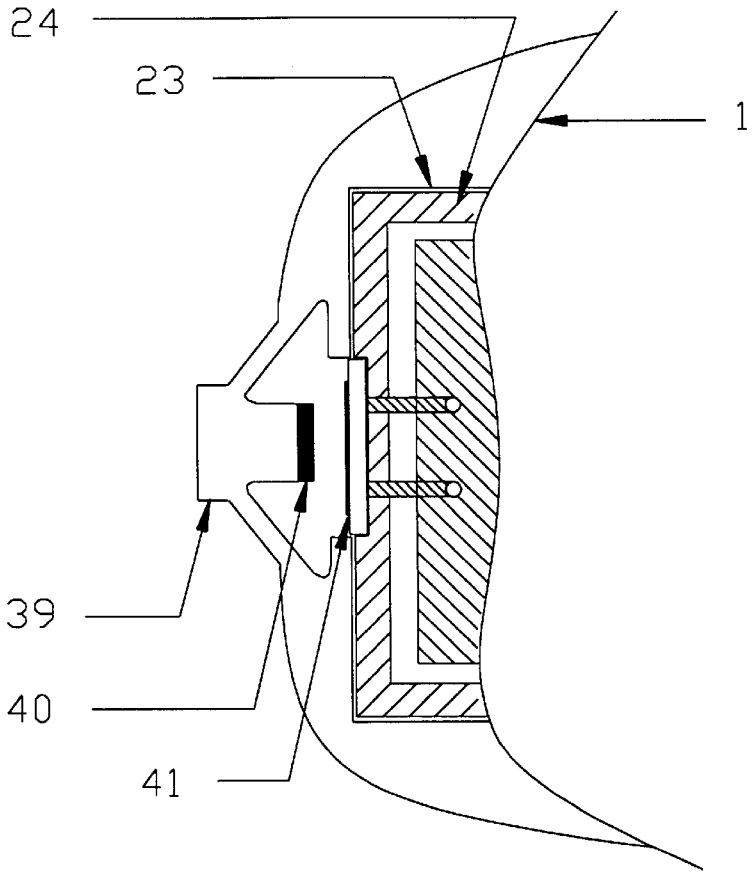
FIG. 8 is a partial top plan view of the sole portion with the manual switch.

In accordance with the present invention, FIG. 8 illustrates a partial top plan view of the sole portion with the conductive rubber switch 42. The actuating part of the switch is preferably molded into the sole which consist of an insulative rubber or polymer actuator 39. A "conductive rubber pill" 40 is added to the inner portion of the insulative material for making contact with the stationary printed circuit contact pad 41. The outer sole portion of the switch 39 can have an unlimited number of shapes such as square, round, rectangular, etc. Furthermore, the surface of the switch can be recessed, embossed, or extend outwardly.

Figure 9:
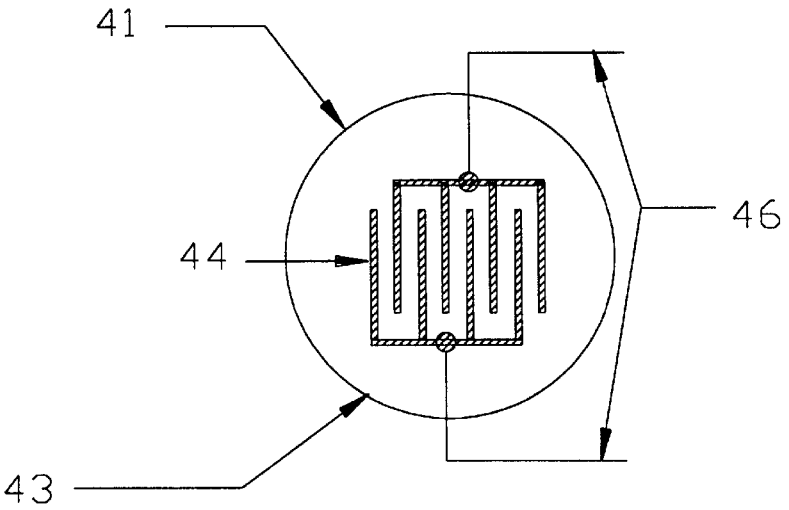
FIG. 9 is a rear view of the contact pad portion of the manual switch.

In accordance with the present invention, FIG. 9 is a rear view of the contact pad portion 41 of the conductive rubber switch 42. This contact pad 41 is part of the conductive rubber switch 42 which allows the wearer to manually control the illuminated display areas. The contact pad 41 consist of a printed circuit board 43 that is plated 44, preferably with conductive carbon ink. This contact pad 41 is recessed into the contact pad cavity 45 of the control module 24 as illustrated on FIG. 7. Each side of the plated patterns 44 shall have leads 46 turned at right angles to be inserted through holes made in the contact pad cavity 45 and into the main printed circuit board 18 holes for soldering. Therefore, the circuit is closed when the switch is depressed and the "conductive rubber pill" 40 makes contact across the two plated patterns 44. The pulse is sensed by the electronic components and circuits 25 (not shown) which condition the signal and causes the optical fiber illuminating display area(s) 2 to activate ON,OFF, FLASH MODE, ALTERNATE COLOR MODE, MOTION ACTIVATE MODE or PRESSURE ACTIVATE MODE, or SEQUENCE IN MOTION MODE. For example, in the PRESSURE ACTIVATE MODE; the pressure sensitive membrane switch 27 is enabled for illuminating the optical fiber display area 2.

Figure 10:
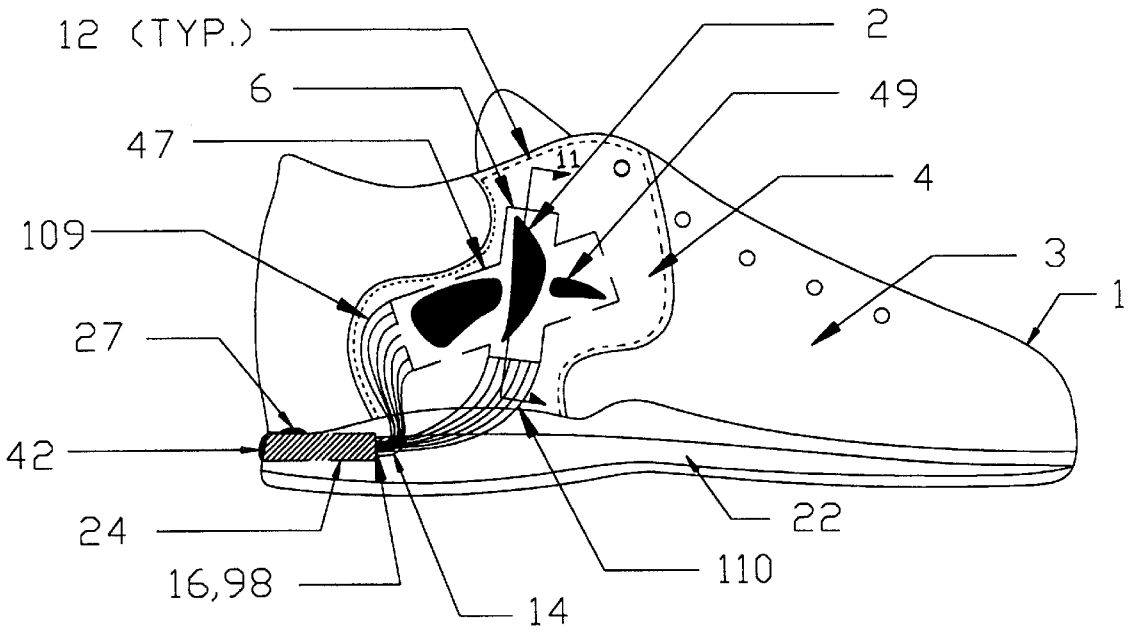
FIG. 10 is a side view of a second embodiment of an athletic footwear made in accordance with the present invention to include two optical fiber illuminating display areas and control module.

In accordance with the present invention, second embodiment in FIG. 10, illustrates an athletic footwear 1 which includes two optical fiber illuminating display areas 2,49 and control module 24. In this embodiment, the two optical fiber illuminating display areas 2,49 appear to be intersecting, such as may be required by some trademark logos. The present invention provides two optical fiber panels 6,47 applied to the upper portion 3 of the footwear in an overlapping manner in order to meet the present needs. Each optical fiber panel 6,47 is coupled to an LED 16,98 in the control module 24. Therefore, the two LED colors can be made different in order to illuminate the optical fiber display areas accordingly. Moreover, the control module circuits and components 25 can be made to alternate flash the two display areas 2,49. Other illuminating effects for this embodiment are covered in detail description of the control module's circuits and components 25.

Figure 11:
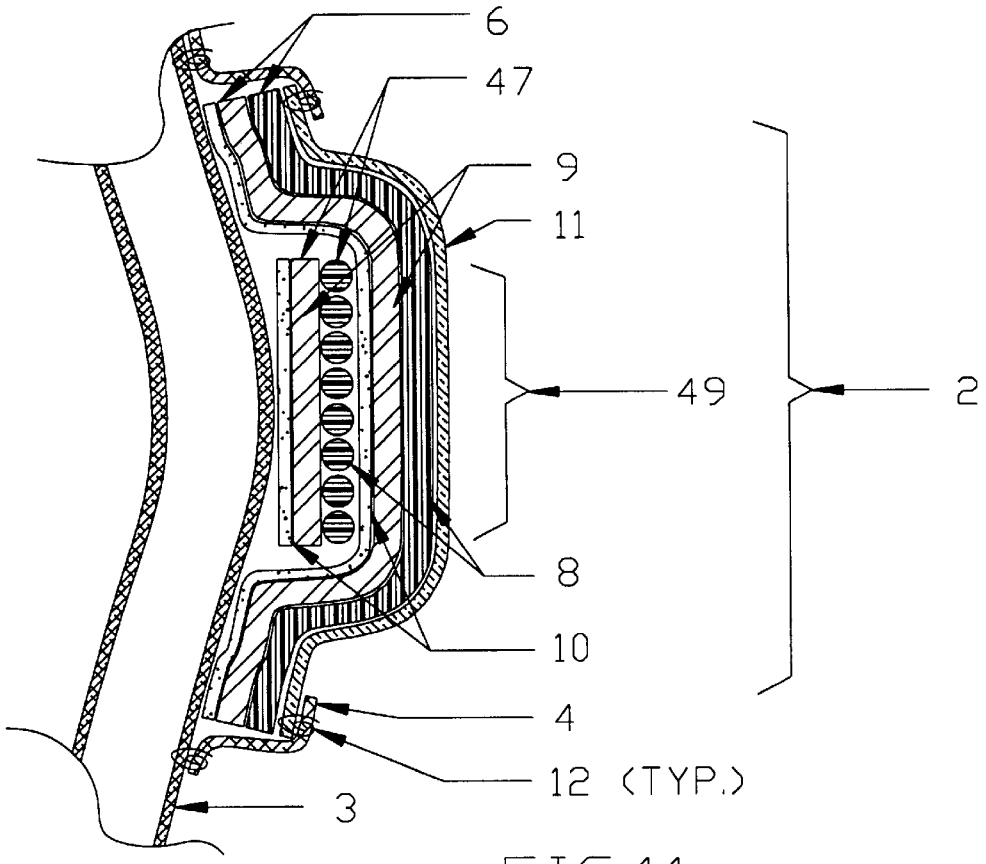
FIG. 11 a cross-sectional view of the optical fiber display area taken along 11—11 of FIG. 10.

In accordance with the present invention, FIG. 11 is a cross-sectional view of the optical fiber display area taken along B—B of FIG. 10. This figure illustrates the construction of the optical fiber display areas. In this embodiment, optical fiber panel 'B' 6 is affixed to the shoe upper 3 with an adhesive material 10, such as double-sided tape or glue, then optical fiber panel 'A' 47 is affixed over it in the same manner. The opening or window is formed by an upper overlay 4 which defines the shape of the illuminated areas on the footwear 1. The shape of the illuminated display area can have an unlimited number of figures which are preferably made by die-cutting the overlay 4 material. As an example, FIG. 10 illustrates an irregular shape depicting an unknown company trademark. Moreover, this opening or window is covered with a decorative layer 11 (such as clear or translucent plastic film) which protects the underlying optical fiber panels 6,47 from the elements of dirt and physical damage. This decorative layer 11 is preferably stitched 12 to the overlay 4 at its die-cut perimetric edges. Furthermore, the upper overlay 4 material is preferably stitched 12 to the shoe upper 3 at its outer perimetric edges.

Figure 12:
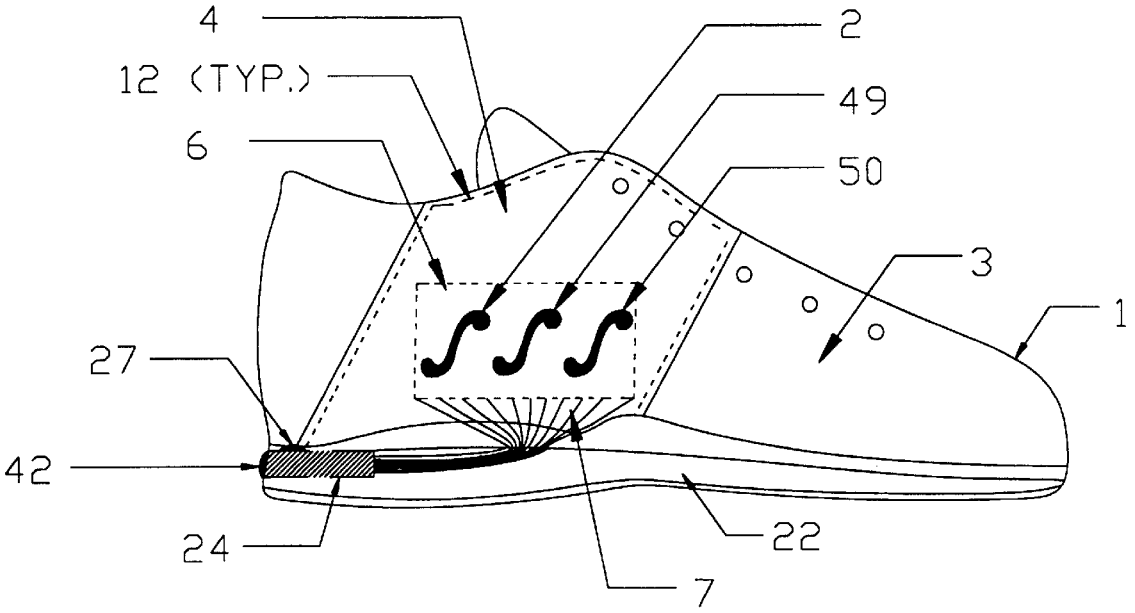
FIG. 12 is a side view of a third embodiment of an athletic footwear made in accordance with the present invention to include three optical fiber illuminating display areas and control module.

In accordance with the present invention, third embodiment in FIG. 12, illustrates an athletic footwear 95 which includes three optical fiber illuminating display areas 2,49, 50 and control module 24. In this embodiment, three illuminated optical fiber display areas 2,49,50 are provided by subdividing the "tail" portions of the optical fiber panel 6 into three bundles which are further coupled into three LED's 16,98,99 in the control module 24. This embodiment provides utmost visual impact when combined with the control module circuits and components 25 which sequence the three display areas 2,49,50 in motion. Other illuminating effects for this embodiment are covered in detail description of the control module circuits and components 25. Another preferred embodiment for this shoe 1 is to make the opening or window frame large enough to allow visibility of all three display areas 2,49,50. Moreover, by adding an opaque decorative film that is die-cut (making the openings that outline the display areas) it is made easier to stitch the perimetric edges of the clear or translucent film. This opaque film shall be layed underneath the clear or translucent layer of protective film 11.

Figure 13:
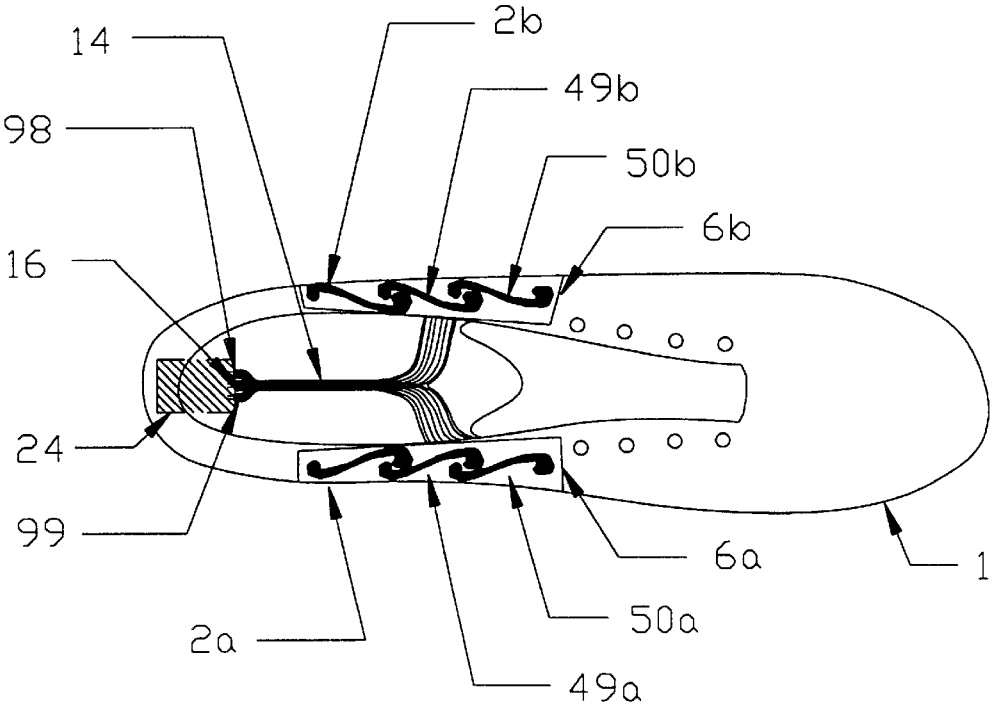
FIG. 13 is a top plan of the footwear in FIG. 12, illustrating optical fiber display area on both sides of the footwear

In accordance with the present invention, FIG. 13 is a top plan of the footwear in FIG. 12, illustrating optical fiber display areas 2*a*,2*b*,49*a*,49*b*,50*a*,50*b* on both sides of the footwear. In this embodiment a "tunnel" 14 large enough to hold both "tail" portions 7*a*,7*b* is made in the midsole 22. Two optical fiber panels 6*a*, 6*b* are applied, one on each side of the shoe. The subdivided "tail" portions of each panel can be bundled with the other panel's subdivided "tail" portions to create the same illuminating effects on both sides of the shoe. Furthermore, using the control module's sequence mode, the bundles can be grouped to display sequence of the two sides in same or opposite directions. Other illuminating effects for this embodiment are covered in detail description of the control module circuits and components 25.

Figure 14:
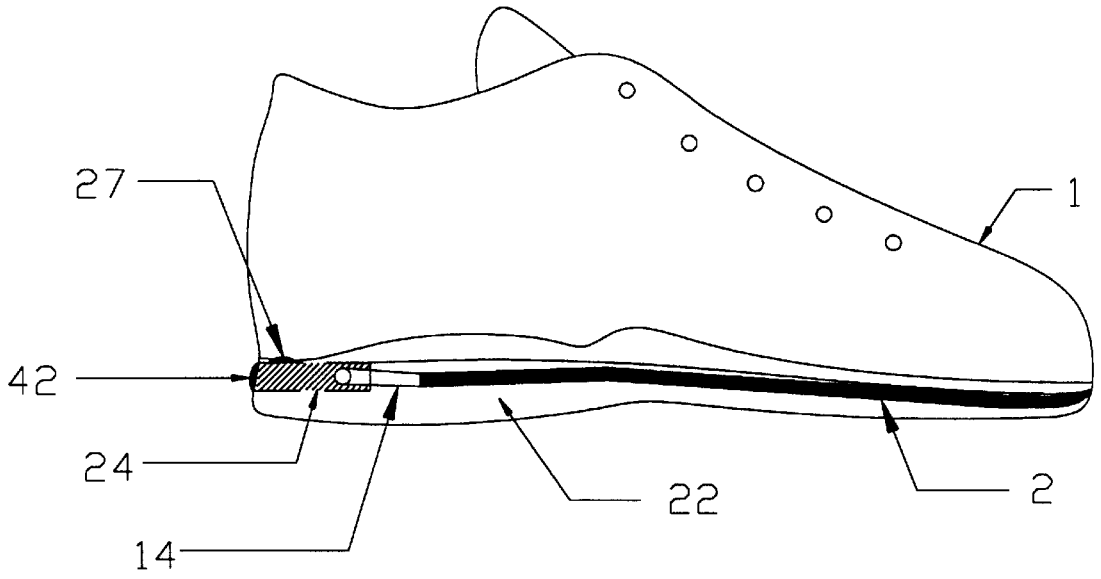
FIG. 14 is a side view of a forth embodiment of an athletic footwear made in accordance with the present invention to include an optical fiber illuminating display area in the sole portion of the footwear and control module.

FIG. 14 is a side view of a forth embodiment of an athletic footwear 1 made in accordance with the present invention to include an optical fiber illuminating display area 2 in the sole portion of the footwear and control module 24. This embodiment is similar to previous embodiments described in detail in that it can have: a manually activating conductive rubber switch 42; pressure sensitive membrane switch 27; control module 24; light emitting devices 16,98; components and circuits 25 for making the illuminating display areas turn on, off, flash, alternate colors, sequence in motion; and batteries 26.

Figure 15:
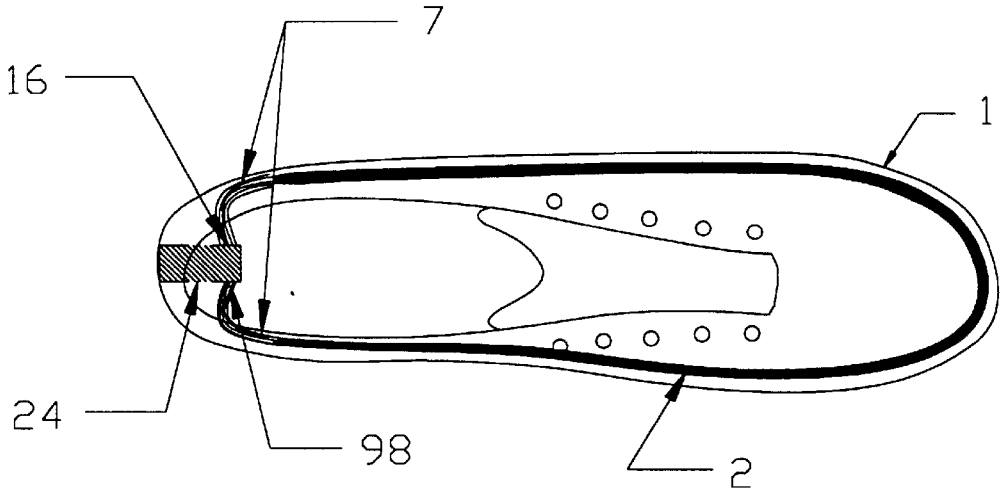
FIG. 15 is a top plan of the footwear in FIG. 14, illustrating optical fiber display area along the perimeter of the sole.

In accordance with the present invention, FIG. 15 is a top plan of the footwear in FIG. 14, illustrating optical fiber display area along the perimeter of the sole. This embodiment provides an optical fiber display panel that has two "tail" ends 7*a*,7*b* for coupling into the light emitting devices 16,98. The object of this embodiment is to provide uniform light distribution on continuously along the perimeter of the shoe.

Figure 16:
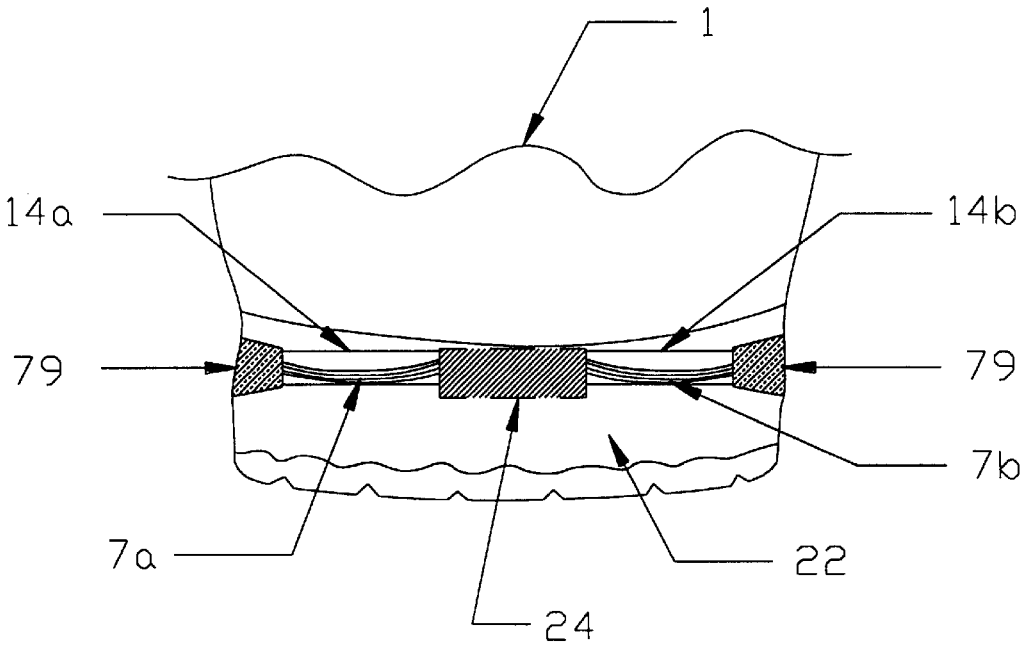
FIG. 16 is a rear view of the footwear in FIG. 14, illustrating the routing of the tail portion of the optical fiber panel.

FIG. 16 is a rear view of the footwear in FIG. 14, illustrating the routing of the tail portion of the optical fiber panel. In this view it can be seen that two "tunnels" 14*a*,14*b* are made in the midsole 22 for routing the "tail" ends 7*a*,7*b* of the optical fiber panel from the light emitting devices 16,98 in the control module 24 to the "light cavity" 79. This "light cavity" 79 and "tunnels" 14*a*,14*b* are preferably molded into the midsole 22 during manufacturer of the sole. Furthermore, the present invention can embody this "light cavity" 79 into present sole designs which incorporate similar cavities for other purpose, such as an "air" sole cavity.

Figure 17:
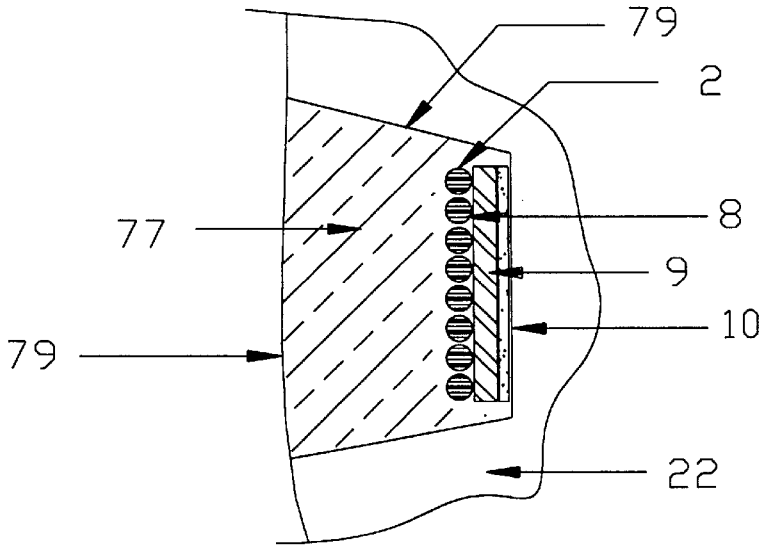
FIG. 17 is a partial cross-sectional view of the footwear in FIG. 14 illustrating the "light cavity".

FIG. 17 is a partial cross-sectional view of the footwear in FIG. 14, illustrating the "light cavity" 79. The optical fiber display panel is applied with an adhesive material 10 (such as double-sided tape or glue) preferably to a flat surface in the rear portion of the "light cavity" 79. The remaining portion of the cavity can be filled with a translucent material 77, such as transparent grades of silicon.

Figure 18:
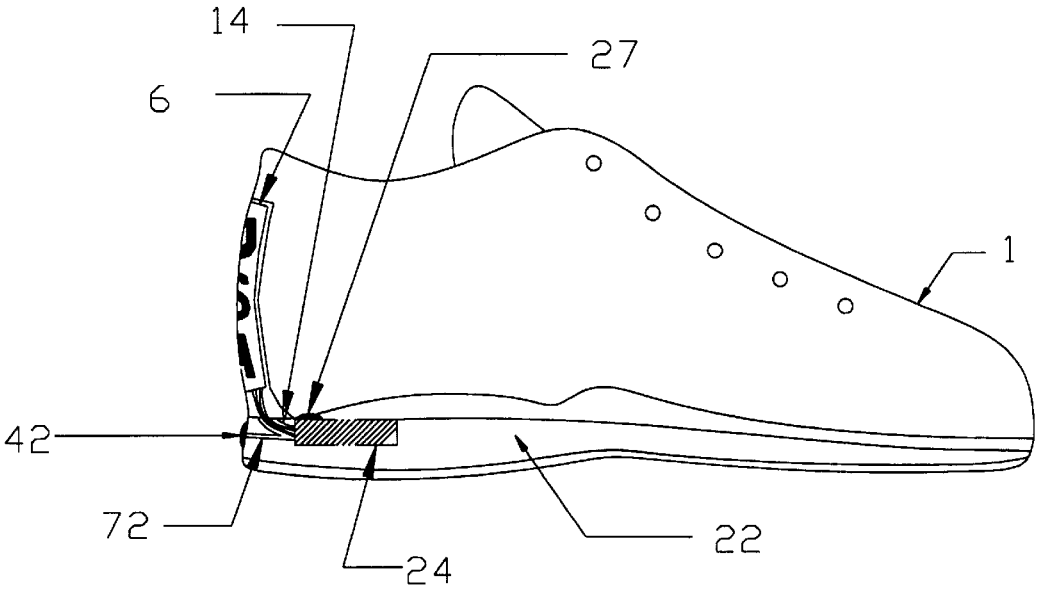
FIG. 18 is a side view of a fifth embodiment of an athletic footwear made in accordance with the present invention to include an optical fiber illuminating display area on the rear upper portion of the footwear and control module.

FIG. 18 is a side view of a fifth embodiment of an athletic 1 made in accordance with the present invention to include an optical fiber illuminating display area 2 on the rear upper portion 3 of the footwear and control module 24. This embodiment is similar to previously described embodiments, except for the apparent need to mount the "conductive rubber switch" 42 remote from the control module 24, primarily due to the location of the optical fiber panel 6. However, the present invention provides an "auxiliary tunnel" 72 to route the wires from the contact pad to the control module 24.

Figure 19:
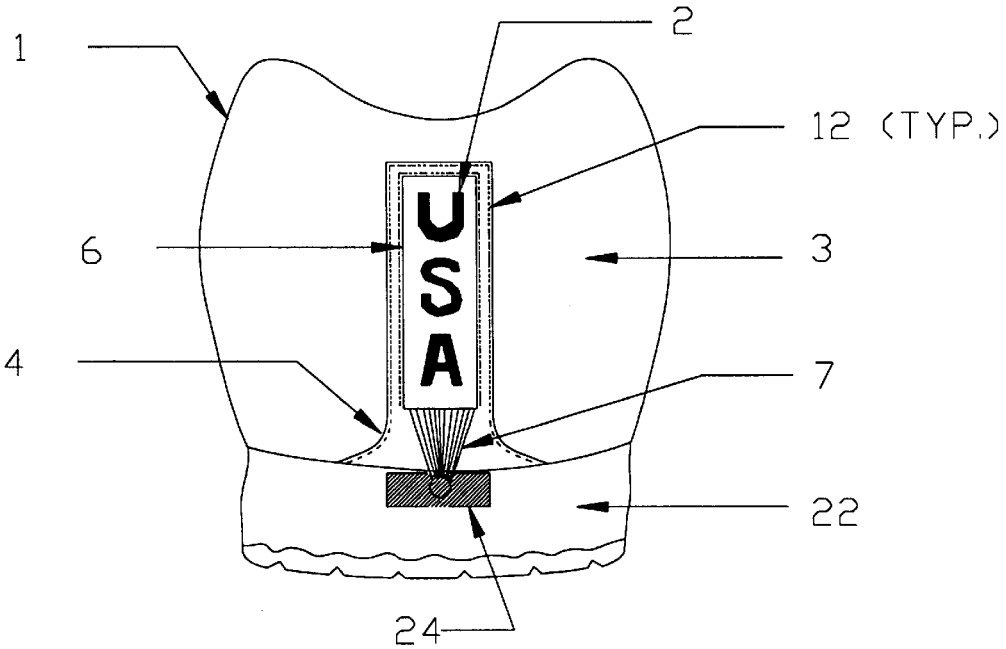
FIG. 19 is a rear view of the footwear in FIG. 18

FIG. 19 is a rear view of the footwear in FIG. 18, illustrating the optical fiber display area 2. This embodiment is very similar to the first embodiment in FIG. 1 in terms of the methods described for adaptation of the optical fiber panel to the upper portion of the shoe.

Figure 20:
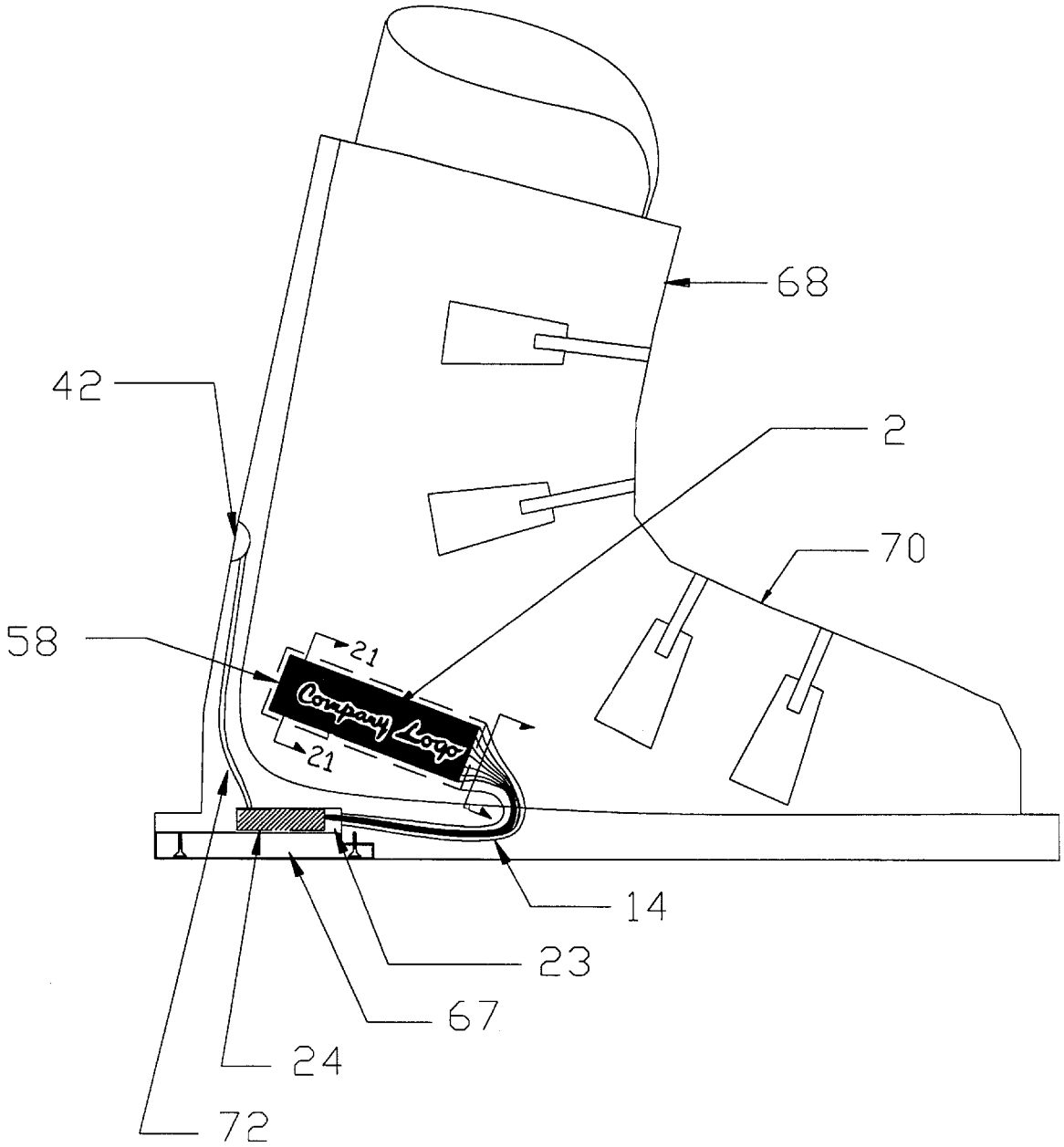
FIG. 20 is a side view of a sixth embodiment of a SKI BOOT footwear made in accordance with the present invention to include an optical fiber illuminating display area on the outer boot portion of the footwear and control module.

FIG. 20 is a side view of a sixth embodiment of a SKI boot footwear 70 made in accordance with the present invention to include an optical fiber illuminating display area 2 on the outer boot portion 68 of the footwear and control module 24. In this embodiment, the control module 24 is preferably situated in the heel portion of the boot, underneath a removable heel 67. This removable heel 67 is a common feature in modern SKI boots which can be slightly modified to hold the control module 24. The control module cavity 23 is preferably molded into the outer boot 68 which is typically constructed of polyethylene or polyurethane. In this embodiment the control module's batteries 26 are made accessible by first removing the boot's heel 67. Furthermore, the manual conductive rubber switch 42 is mounted remote from the control module 24, primarily due to proximity with the SKI. The "tunnel" portion 14 used for routing the "tail" portion 7 of the optical fiber panel 6 is preferably molded into the outer boot 68.

Figure 21:
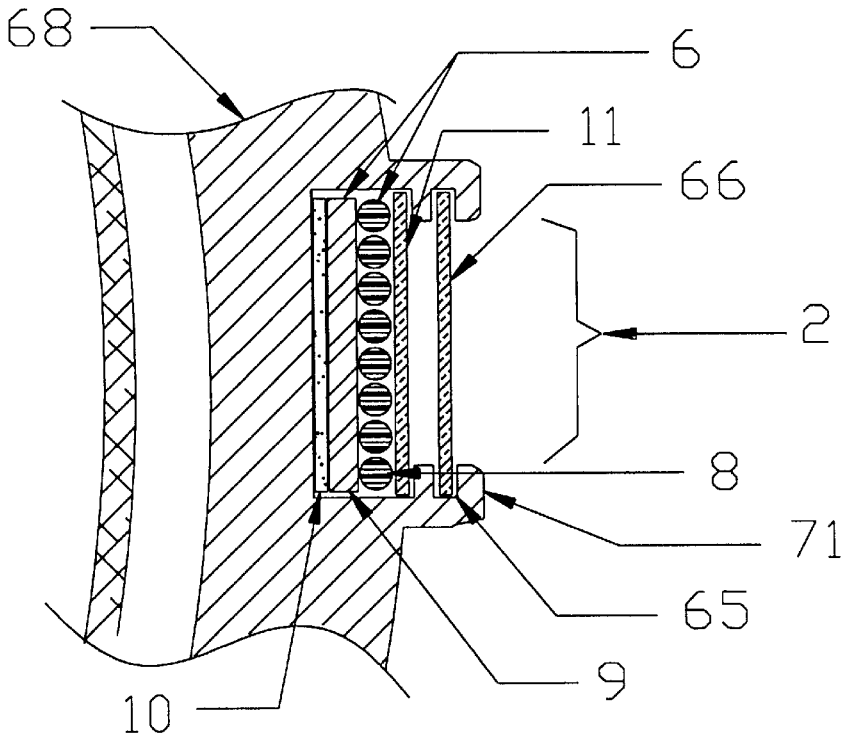
FIG. 21 a cross-sectional view of the optical fiber display area taken along 21—21 of FIG. 20.

FIG. 21 a cross-sectional view of the optical fiber display area taken along C—C of FIG. 20. This view illustrates the construction of the optical fiber display portion of the SKI boot 70. The outer boot 68 is preferably shaped to partially or entirely recess the window frame member 71 made of thermoplastic. This thermoplastic frame member 71 is preferably molded as part of the outer boot molding, made of polyethylene or polyurethane. The optical fiber panel 6 is applied to the back side of this window member 71 with an adhesive material 10, such as double-sided tape or glue. The illuminating display area 2 can be decorated by either surface treatment of the optical fiber panel or by adding a decorative layer 11 containing this design. Surface treatment of the optical fiber panel can be accomplished by abrading, marring, stamping, and laser cutting in accordance with prior known proprietary methods and other conventional methods. The decorative layer 11 can consist of an opaque material die-cut with letters, numbers, etc. to make visible the underlying illuminated display areas. Additionally, the decorative layer 11 can consist of a translucent layer of film, preferably acrylic for best optical clarity, which can contain a design with opaque/translucent letters, numbers, etc. Furthermore, the design on the translucent material is preferably made using conventional black/white/color photocopying or screen printing equipment. An impact resistant translucent thermoplastic 66, preferably made of polycarbonate shall be made to slide through the groove 65 which is molded into the window frame member 71. This impact resistant thermoplastic 66 is primarily used to protect against the normal impacts that occur when a skier falls.

Figure 22:
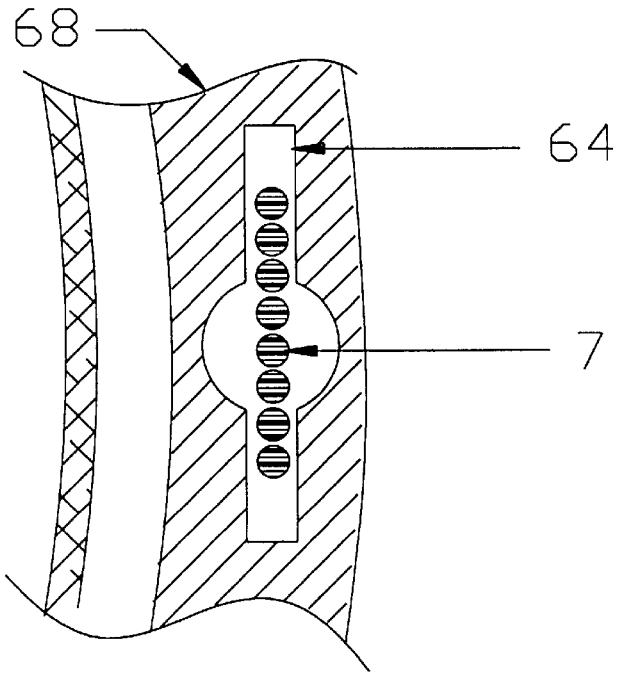
FIG. 22 a cross-sectional view of the optical fiber display area taken along 22—22 of FIG. 20.

FIG. 22 a cross-sectional view of the optical fiber display area taken along D—D of FIG. 20. This view illustrates a "tail converging cavity" 64 which allows the "tail" portion 7 of the optical fiber panel to be inserted through the thermoplastic boot. This cavity 64 is shaped in this manner to allow the "tail" 7 to converge into the "tunnel" 72.

Figure 23:
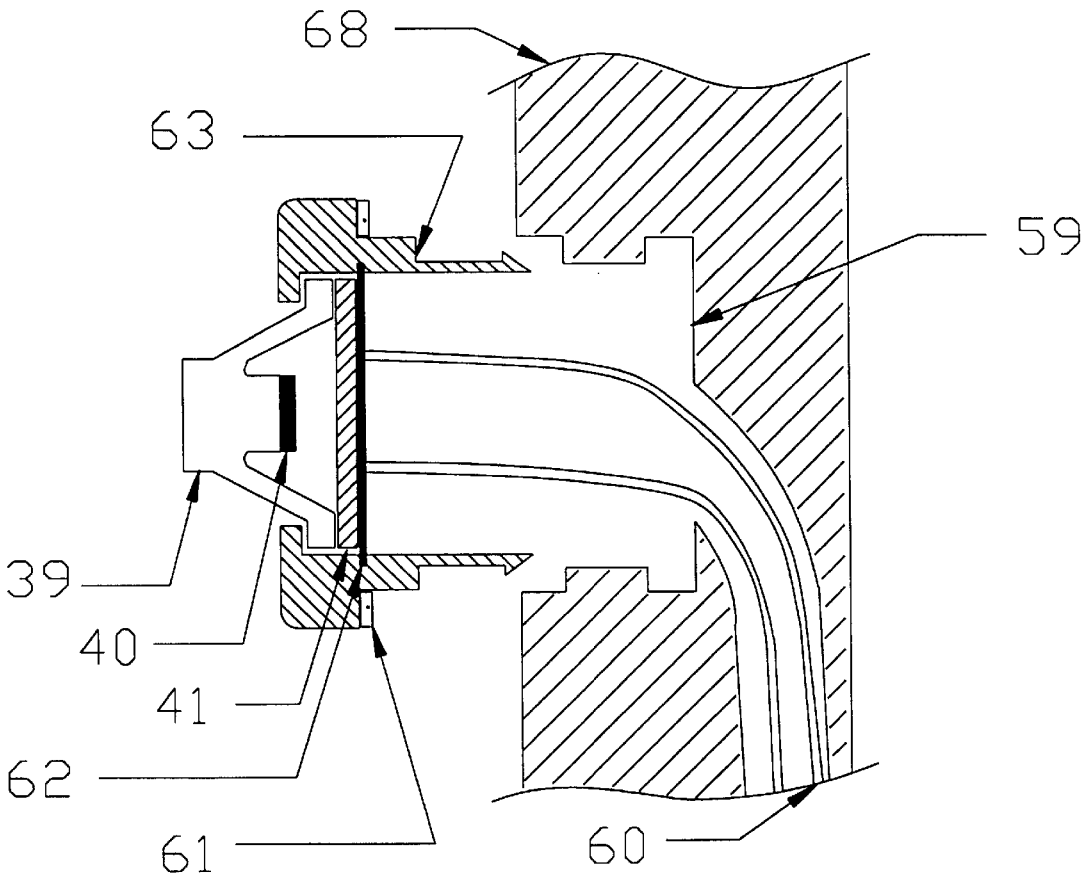
FIG. 23 a cross-sectional view of the manual switch on the footwear in FIG. 20.

FIG. 23 a cross-sectional view of the manual conductive rubber switch 42 of the footwear FIG. 20. This manual switch 42 provides a sealed assembly consisting of an insulative rubber actuator 39; a "conductive rubber pill" 40; a contact pad 41; a snap-in thermoplastic 63; a retaining ring 62; a flat washer 61, preferably made of rubber/silicon material; and a switch cavity 59, preferably molded as part of the boot. Furthermore, an "auxiliary tunnel" 72 from the switch cavity 59 to the control module 24 provides a conduit for the wires in between. The retaining ring 62 holds the insulative rubber portion 39 and contact pad 41 against the front portion of the snap-in mounting 63. The switch cavity 59 shall be made to accept the snap-in mounting 63 with sufficient pressure to seal the washer 61 against the outer boot.

Figure 24:
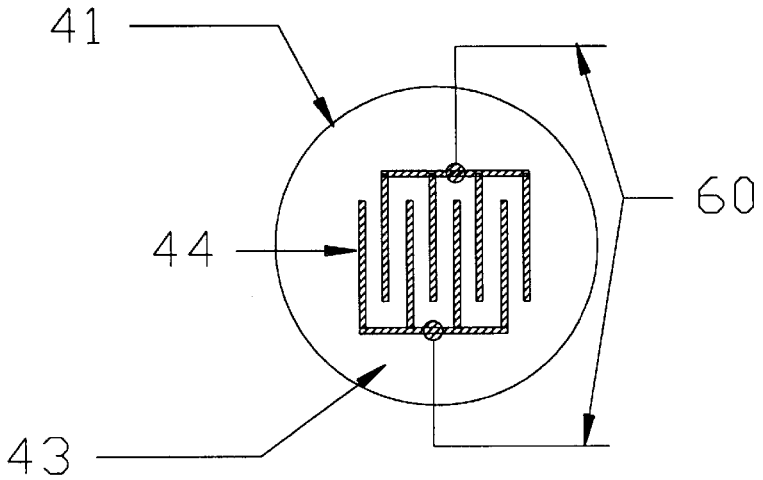
FIG. 24 is a rear view of the contact pad portion of the manual switch in FIG. 20.

FIG. 24 is a rear view of the contact pad portion of the manual switch 42 in FIG. 20. This contact pad 41 is part of the "conductive rubber switch" 42 which allows the wearer to manually control the illuminated display areas 69. The contact pad 41 consist of a printed circuit board 43 that is plated 44, preferably with conductive carbon ink. In this embodiment, two wires 60 are soldered to the printed circuit board 43. Therefore, the circuit is closed when the switch is depressed and the "conductive rubber pill" 40 makes contact across the two plated patterns 44. The pulse is sensed by the electronic circuits and components 25 which condition the signal and causes the optical fiber illuminating display area(s) 2 to activate ON, OFF, FLASH MODE, ALTERNATE FLASH MODE, ALTERNATE COLOR MODE, MOTION ACTIVATE MODE or PRESSURE ACTIVATE MODE, or SEQUENCE IN MOTION MODE.

Figure 25:
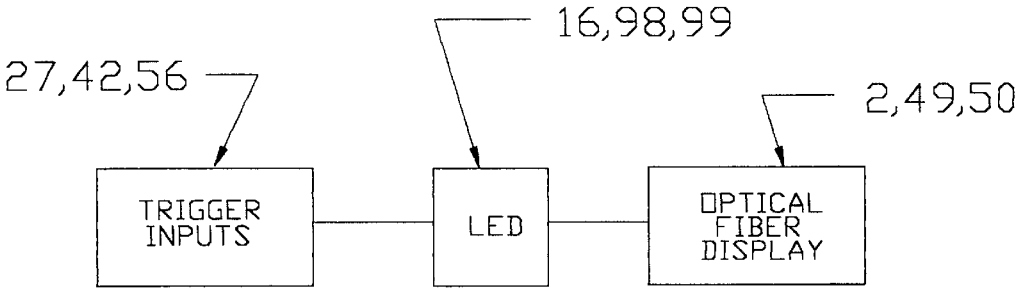
FIG. 25 is a block diagram of components and circuits for activating an optical fiber display area(s) by a trigger input device, such as pressure sensitive or motion switch, in accordance with the present invention.
Figure 26:
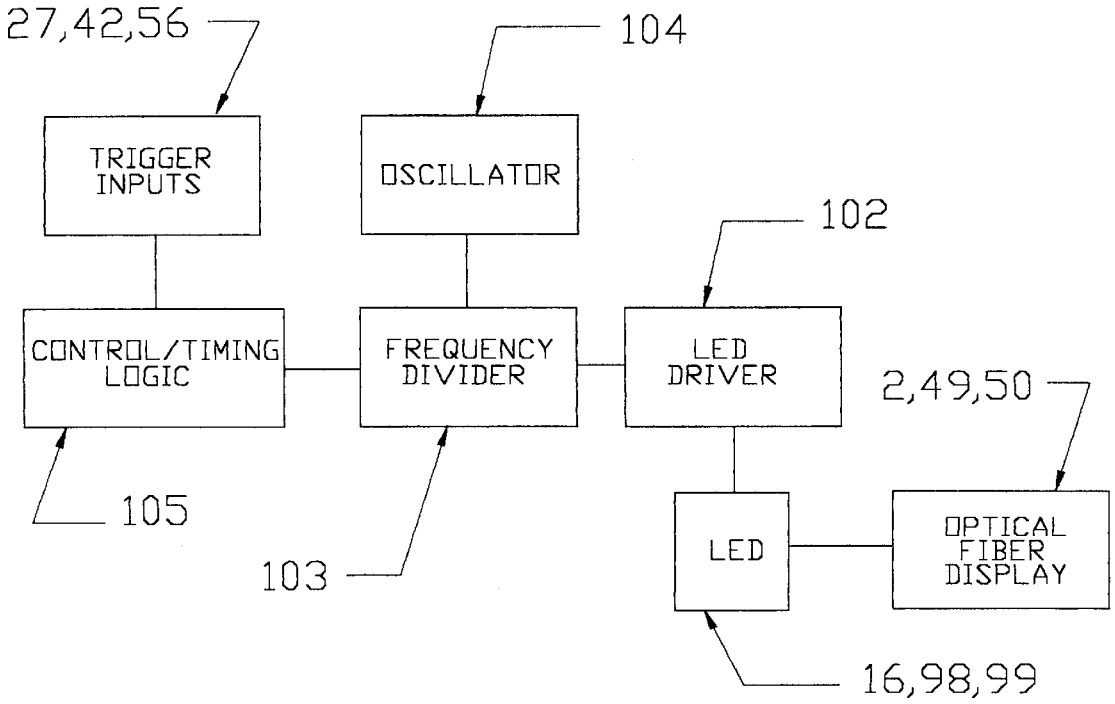
FIG. 26 is a block diagram of components and circuits for activating an optical fiber display area(s) by trigger input devices in addition to providing control/timing logic, oscillation, frequency division, and LED driver, in accordance with the present invention.

In accordance with the present invention, the block diagrams in FIG. 25 and FIG. 26 have been originated to devise the circuits and components 25 needed to activate illumination for the optical fiber display areas. These block diagrams also minimize the quantity of schematics needed to cover the scope and intent of this invention.

Figure 27:
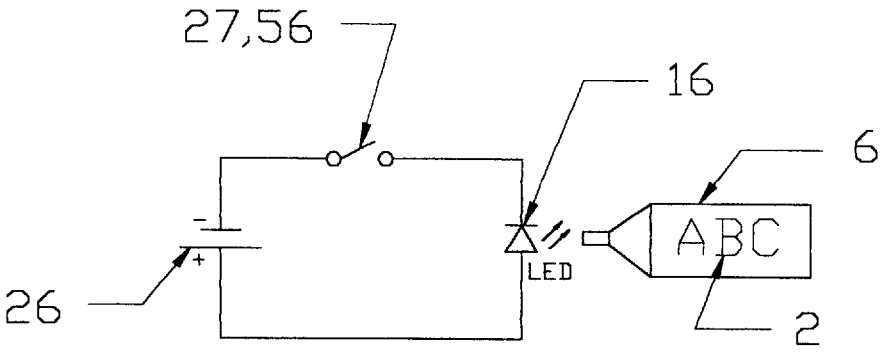
FIG. 27 is a schematic diagram of components and circuits for activating an optical fiber display area(s) by a trigger input device, such as pressure sensitive or motion switch, in accordance with the present invention.

First, FIG. 25 illustrates a block diagram of components and circuits 25 for activating an optical fiber display area(s) 2 by a trigger input device. Using a simple series circuit, on each interval of time in which the switch is closed consequently the illuminating display area will be illuminated. For example, in FIG. 27 a schematic diagram of components and circuits 25 for activating an optical fiber display area(s) 2 shows a pressure sensitive 27 or motion switch 56 as the trigger input device.

Figure 28:
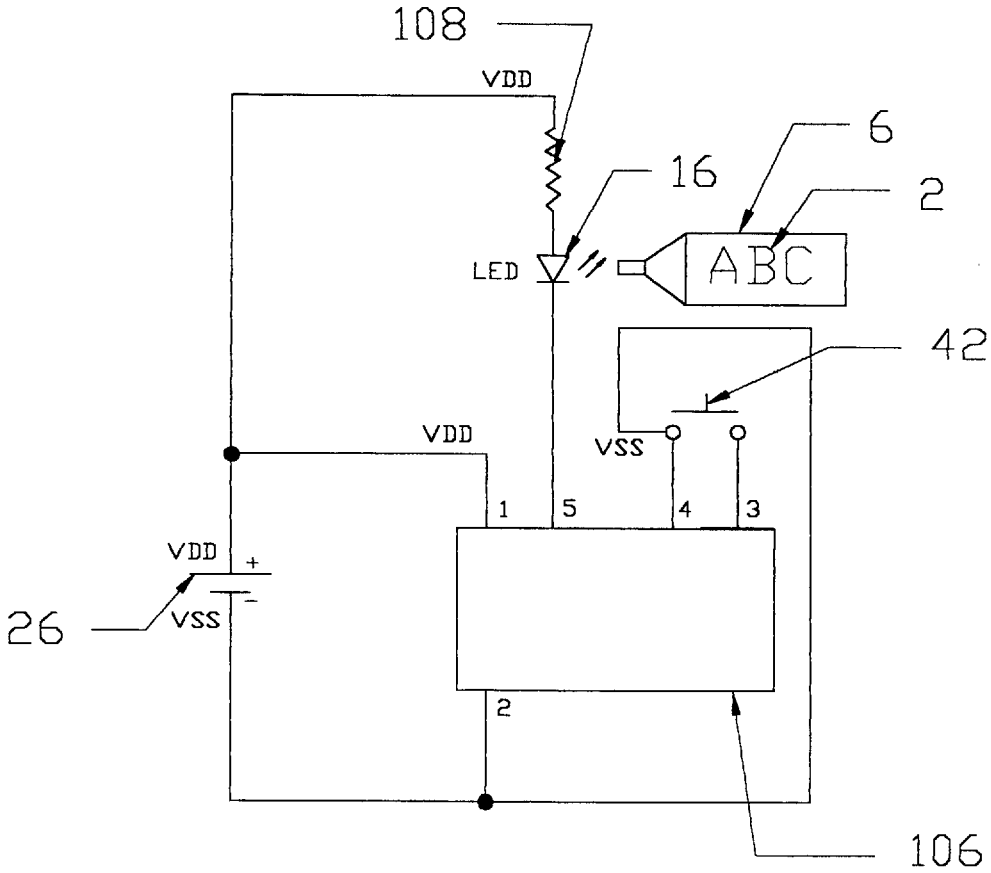
FIG. 28 is a schematic diagram of components and circuits for flashing an optical fiber display area(s) according to enabling ON/OFF by a manual switch.

In accordance with the present invention, FIG. 26 is a block diagram of components and circuits 25 for activating an optical fiber display area(s) by trigger input devices in addition to providing control/timing logic 105, oscillator 104, frequency divider 103, and LED driver 102. For example, the trigger input devices may include a pressure sensitive membrane switch 27, motion switch 56, manual switch 42, or other similar. The control/timing logic 105 reads the trigger input (s) and performs logical and timing functions to activate the optical fiber display areas. The oscillator 104 generates a frequency, usually in the order of kilohertz. This high frequency then requires frequency division in order for the human eye to detect the display area as flashing (usually in the order of 10 hertz or less). The frequency divider circuit 103 provides the LED driver 102 (such as a common emitter transistor) with low frequency oscillations. The LED driver amplifies the signal to drive the LED(s) which illuminates the optical fiber display area In accordance with the present invention, FIG. 28 is a schematic diagram of components and circuits 25 for flashing an optical fiber display area(s) 2 according to enabling ON/OFF by a manual switch 42. Using an integrated circuit chip 106, such as the HT-201XX which includes an oscillator 104, freq. divider 103, control/timing logic 105, and driver 102 built into one compact and economical package, the LED 16 is enabled/disabled to flash by depressing a manual switch 42, such as the conductive rubber switch previously mentioned. The resistor 108 is used to limit the current through the LED 16.

Figure 29:
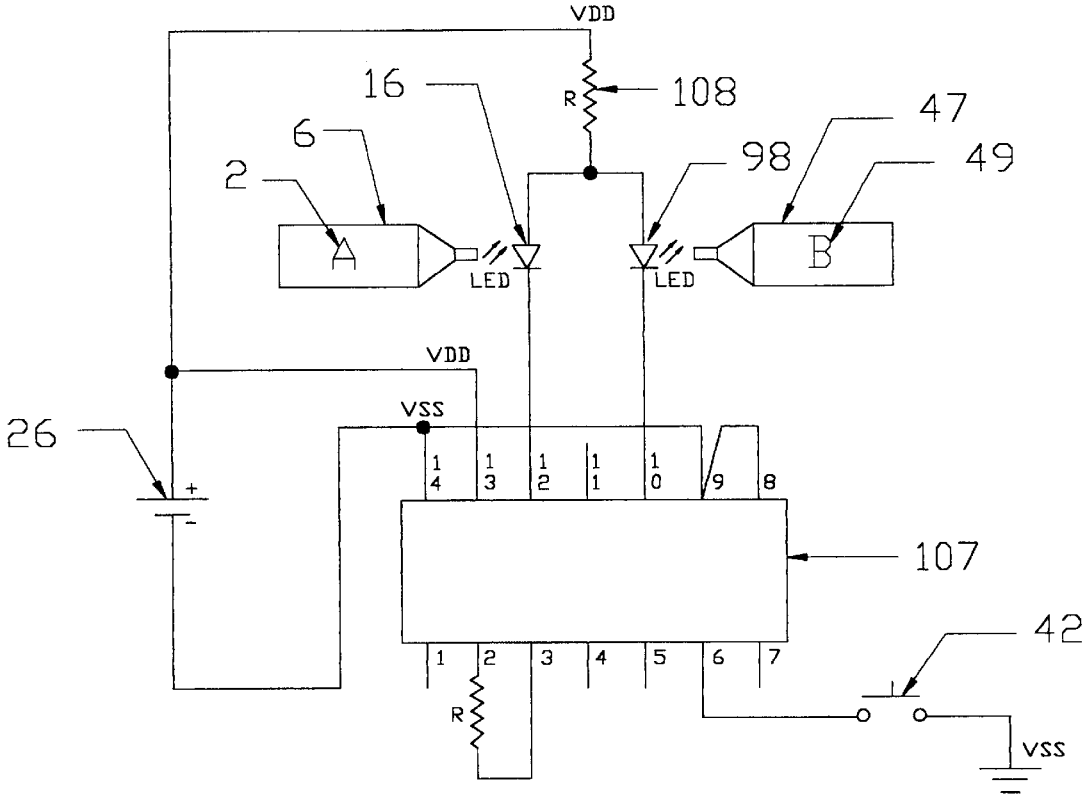
FIG. 29 is a schematic diagram of components and circuits for alternate flashing two optical fiber display areas or alternate colors on an optical fiber display area (using a bicolor LED) according to a trigger input device.

In accordance with the present invention, FIG. 29 is a schematic diagram of components and circuits 25 for alternate flashing two optical fiber display areas 2,49. Alternatively, by removing the jumper between pins 8 and 9 to IC chip 107, such as HT-2021 the two optical fiber display areas 2,49 can be made to flash together in phase. A trigger input, such as from the pressure sensitive membrane switch 27 or motion switch 56 previously mentioned, will cause the display areas to alternate/in-phase flash. In a variation to the present invention, by using a bicolor LED, the optical fiber display area can be made to alternate colors.

Figure 30:
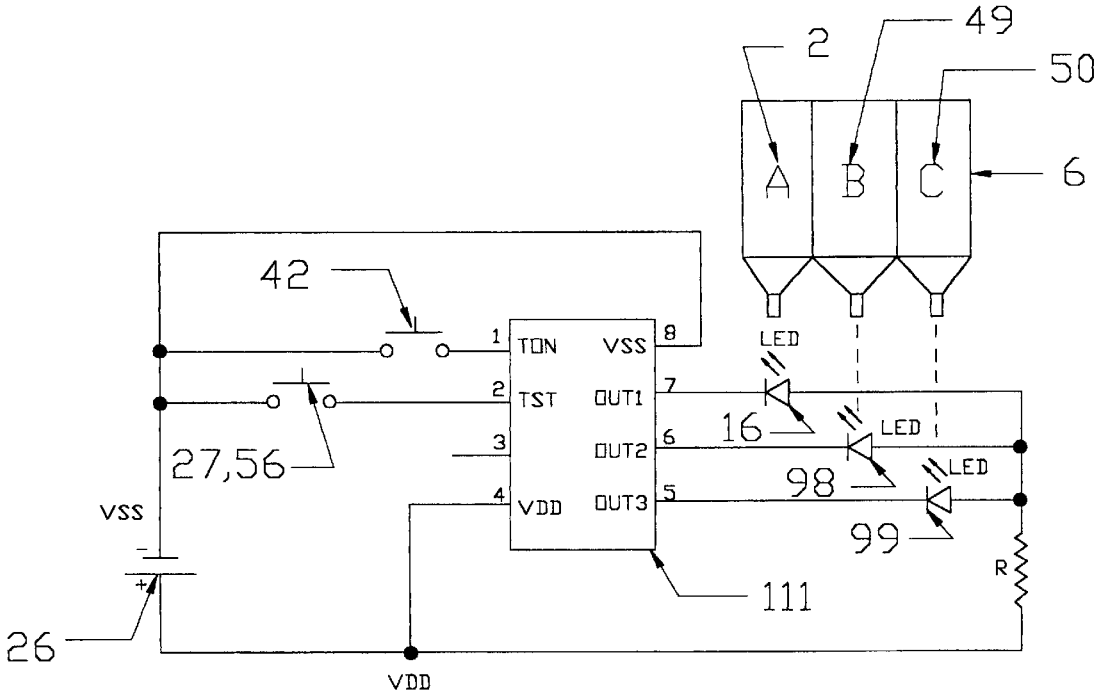
FIG. 30 is a schematic diagram of components and circuits for sequencing in three optical fiber display areas according to a trigger input device and/or a manual switch.

In accordance with the present invention, FIG. 30 is a schematic diagram of components and circuits 25 for sequencing three optical fiber display areas 2,49,50 (part of a subdivided panel 6) according to a trigger input device 27,56 and/or a manual switch 42. The manual switch 42 is used to enable/disable the pressure sensitive membrane switch 27 or motion switch 56. The three LED's 16,98,99 will flash successively (one after the other in turn) between 1 and 7 sequence cycles per trigger input. Using an IC Chip 111, such as the HT-2030 combines the oscillator 104, frequency divider 103, control/timing logic 105, and driver 102 into one compact and economical package.

Figure 31:
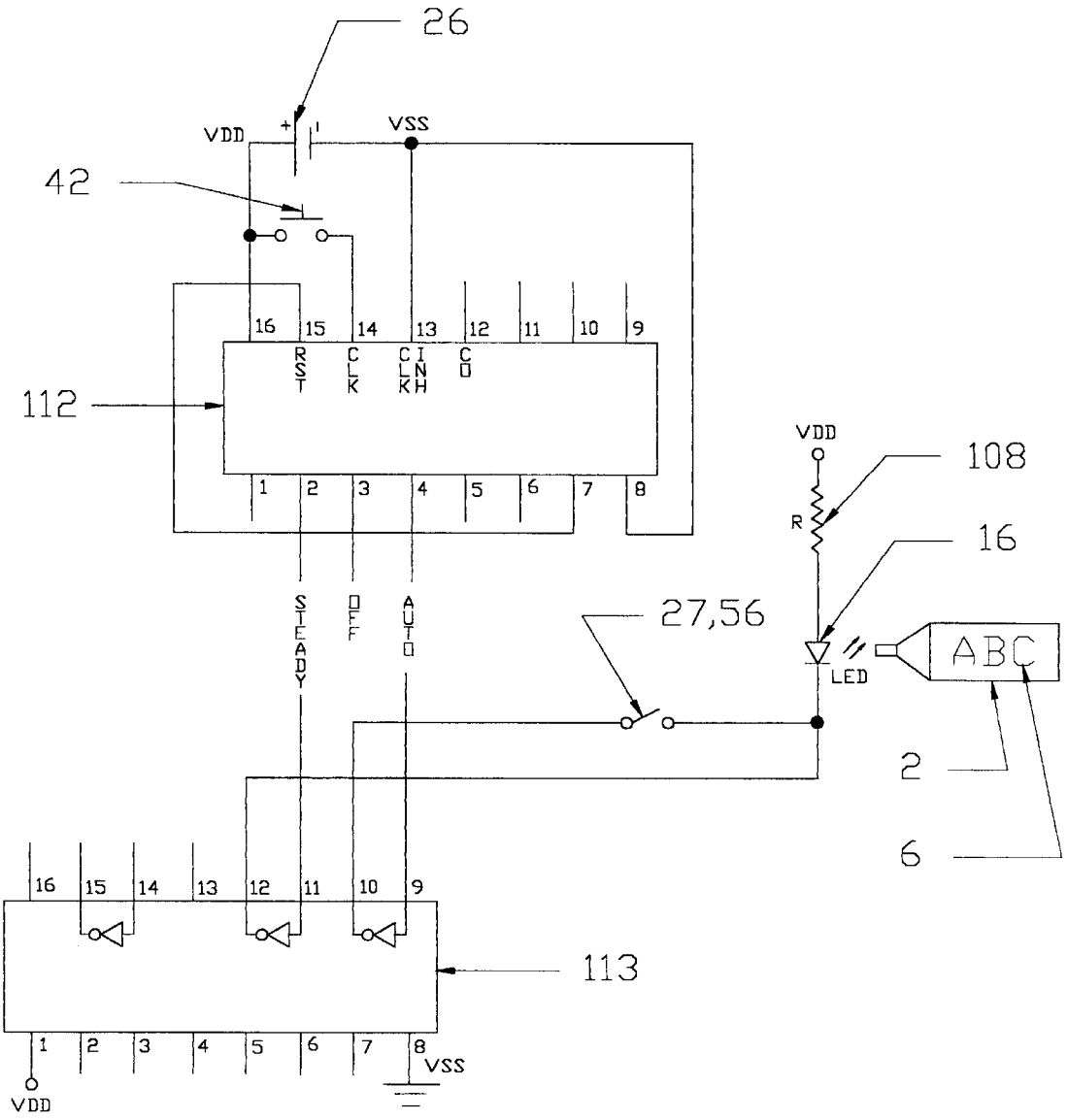
FIG. 31 is a schematic diagram of components and circuits for multi-mode activation of an optical fiber display area(s), including: OFF, ON MODE(steady), AUTO MODE (pressure sensitive or motion switch activation).

In accordance with the present invention, FIG. 31 illustrates a schematic diagram of components and circuits 25 for multimode activation of an optical fiber display area(s) 2, including: OFF, ON MODE(steady), AUTO MODE (pressure sensitive or motion switch activation). Using an integrated circuit chip 112, such as the 4017 Decade Counter, the outputs can be made to toggle by connecting the manual switch 42, such as the conductive rubber switch previously mentioned, to the Clock input of the chip. A jumper from pin 7 (next output "high" after pin 4)) is connected to RST to reset to the OFF mode (pin 3 "high").

The 4049 Hex Inverter 113 is used to invert/buffer the output from the 4017 IC Chip 112 and "sink-in" the current to drive the LED 16. By depressing the manual switch 42 once after the "OFF" mode the output of pin 2 goes "high" which causes the sink-in current to drive the LED ON(steady). By depressing the manual switch 42 again, pin 4 goes "high" which causes the sink-in current to drive the LED 16 only when the pressure sensitive switch 27 or motion switch 56 is made closed. This mode is preferably called "AUTO MODE" since the pressure sensitive or motion switch are self acting to the wearer while he/she is walking, jogging, or running.

In a variation to the present invention, illuminating display areas are provided by substituting thin profile electroluminescent lamps for optical fiber panels and made visible on the footwear by same means as previously described. Similarly, instead of a fiber bundle being routed from the control module to the designated display area, two wires must be installed and connected to the electroluminescent lamp (EL lamp). The components and circuits 25 previously described must be enhanced with a DC to AC inverter (e.g. resonating transformer or IC chip type) due to the EL lamp's AC voltage (30 to 180 Volts AC typically) and frequency (100 to 5000 Hz typically) requirements. A low profile inverter package can be made to fit inside the control module and mounted in the printed circuit board. Similar to the visual outcome of the optical fiber panel, the electroluminescent lamps can be used for advertising (e.g. trademarks, logos, etc.), decoration, and enhancing the visibility of the wearer as previously described in detail.

Having described preferred embodiments of the invention with reference to the accompanying drawings, it will be appreciated that the present invention is not limited to those specific embodiments and that various changes and modifications can be affected therein by one of ordinary skill in the art without departing from the scope or spirit of the invention.

What I claim is:

1. A shoe having an illuminating device formed integral therewith, said device comprising: a reflective substrate panel affixed to said shoe; a plurality of optical fibers having a first end and a second end with a longitudinal length therebetween with at least a portion of said longitudinal length affixed to said substrate panel; light means coupled to said optical fibers; a removable translucent cover placed in parallel arrangement with respect to said substrate panel, said optical fibers disposed between said cover and said panel, said cover including indicia; component and circuit means for activation of said light means; and battery means for supplying power to said component & circuit means and said light means, whereby said shoe is useful for advertising, decoration, and enhancing the visibility of the footwear.

2. The illuminating device according to claim 1 wherein said optical fibers have at least one light emitting portion located along said longitudinal length surface.

3. The illuminating device according to claim 2 wherein said light emitting portion has been treated by a method selected from the group consisting of marring, abrasion, heating, stamping, refractive coatings, cladding, and engraving.

4. The illuminating device according to claim 1 wherein said optical fibers are woven to form a light emitting fabric.

5. The illuminating device according to claim 1 whereby said optical fibers are subgrouped into a plurality of fiber bundles and respectively coupled into a plurality of light means, providing a subdivided optical fiber display panel.

6. The illuminating device according to claim 1 wherein said footwear includes a plurality of substrate panels whereby their optical fibers are respectively coupled into a plurality of light emitting devices.

7. The illuminating device according to claim 1 wherein said transparent cover is available for placement of color filters.

8. The illuminating device according to claim 1 wherein said transparent cover is available for placement of an advertisement thereon.

9. The illuminating device according to claim 1 wherein said transparent cover is available for placement of decoration thereon.

10. The illuminating device according to claim 1 wherein said transparent cover is available for placement of a picture or photograph.

11. The illuminating device according to claim 1 wherein said transparent cover is available for placement of a trademark or logo.

12. The illuminating device according to claim 11 wherein said transparent cover is constructed of impact resistant thermoplastic polymer.

13. The illuminating device according to claim 1 wherein said light means includes incandescent lamps, fluorescent lamps, light emitting diodes (LED's), and electroluminescent lamps.

14. The illuminating device according to claim 1 wherein said battery means includes a removable cover means to allow battery replacement.

15. The illuminating device according to claim 1 wherein said component and circuit means includes a pressure switch whereby said light means and optical fiber display is activated upon weight applied by the wearer of the footwear.

16. The illuminating device according to claim 15 wherein said pressure switch is further defined as a pressure sensitive membrane switch placed in the sole portion of the footwear.

17. The illuminating device according to claim 1 wherein said component and circuit means includes a sealed switch positioned in the shoe, whereby said switch provides user-directed control of said electronic components and circuits, pressure switch, and motion switch, allowing said optical fiber display to activate a mode selected from the group consisting of on-off mode, flash mode, alternate color mode, alternate flash mode, motion activate mode, pressure activate mode, and sequence in motion mode.

* * * * *